US010731938B2

(12) United States Patent
Alicea, Jr.

(10) Patent No.: US 10,731,938 B2
(45) **Date of Patent: *Aug. 4, 2020**

(54) ELECTRONIC FIREARM

(71) Applicant: Benjamin Alicea, Jr., Oldsmar, FL (US)

(72) Inventor: Benjamin Alicea, Jr., Oldsmar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/173,550

(22) Filed: Oct. 29, 2018

(65) Prior Publication Data

US 2019/0204037 A1 Jul. 4, 2019

Related U.S. Application Data

(60) Continuation of application No. 15/384,882, filed on Dec. 20, 2016, now Pat. No. 10,113,823, which is a division of application No. 14/818,638, filed on Aug. 5, 2015, now Pat. No. 9,551,546.

(60) Provisional application No. 62/033,405, filed on Aug. 5, 2014.

(51) Int. Cl.

| | |
|---|---|
| ***F41A 19/46*** | (2006.01) |
| ***F41A 19/59*** | (2006.01) |
| ***F41A 19/10*** | (2006.01) |
| ***F41A 19/12*** | (2006.01) |
| ***F41A 19/14*** | (2006.01) |
| ***F41A 17/20*** | (2006.01) |
| ***F41A 19/64*** | (2006.01) |
| ***F41A 3/66*** | (2006.01) |
| ***F41A 17/06*** | (2006.01) |

(52) U.S. Cl.

CPC ..... *F41A 19/59* (2013.01); *F41A 3/66* (2013.01); *F41A 17/06* (2013.01); *F41A 17/20* (2013.01); *F41A 19/10* (2013.01); *F41A 19/12* (2013.01); *F41A 19/14* (2013.01); *F41A 19/64* (2013.01)

(58) Field of Classification Search

CPC ..... F41A 19/46; F41A 19/58; F41A 19/59; F41A 19/10; F41A 19/12; F41A 19/14; F41A 19/64; F41A 19/65; F41A 19/67; F41A 17/063; F41A 17/56

USPC ..... 42/84; 89/28.05, 28.1, 135

See application file for complete search history.

(56) References Cited

U.S. PATENT DOCUMENTS

| | | | | | |
|---|---|---|---|---|---|
| 1,331,018 | A * | 2/1920 | Luthy | H01M 2/18 | 429/143 |
| 2,780,882 | A * | 2/1957 | Temple | F41A 19/58 | 42/84 |
| 3,045,555 | A * | 7/1962 | Stoner | F41A 19/46 | 89/142 |
| 3,301,133 | A * | 1/1967 | Sturtevant | F41A 19/03 | 89/131 |

(Continued)

*Primary Examiner* — Michael D David

(74) *Attorney, Agent, or Firm* — Taft Stettinius & Hollister LLP

(57) ABSTRACT

There is disclosed herein systems, methods and apparatus relating to a firearm with an electronically operable firing system to fire projectiles from the firearm. A firing mechanism is provided for mechanically and electronically firing a firearm, and a selector mechanism allows for selection of a safe mode, an electronic firing mode or a mechanical firing mode for the firearm. There also includes an electronic controller and shooter interface for controlling firing of a firearm in an electronic mode of firing.

11 Claims, 22 Drawing Sheets

(56) References Cited

U.S. PATENT DOCUMENTS

| | | | | |
|---|---|---|---|---|
| 3,442,173 | A * | 5/1969 | Muller | F41A 19/46 89/127 |
| 4,727,670 | A | 3/1988 | Krouse | |
| 4,793,085 | A | 12/1988 | Surawski et al. | |
| 5,251,533 | A | 10/1993 | Layton | |
| 5,465,518 | A | 11/1995 | Blaser | |
| 5,713,150 | A | 2/1998 | Ealovega | |
| 5,727,538 | A | 3/1998 | Ellis | |
| 6,412,207 | B1 | 7/2002 | Crye et al. | |
| 6,442,860 | B1 | 9/2002 | Allan | |
| 6,615,527 | B1 | 9/2003 | Martin | |
| 6,626,165 | B1 | 9/2003 | Styles et al. | |
| 6,976,416 | B2 | 12/2005 | Ealovega | |
| 7,765,999 | B1 | 8/2010 | Stephens et al. | |
| 7,819,051 | B1 | 10/2010 | Beckmann et al. | |
| 8,336,438 | B2 | 12/2012 | Compton et al. | |
| 8,667,881 | B1 | 3/2014 | Hawbaker | |
| 8,807,007 | B2 | 8/2014 | Alicea | |
| 9,151,559 | B2 | 10/2015 | Alicea, Jr. | |
| 9,395,130 | B2 | 7/2016 | Jacobson | |
| 9,429,379 | B2 | 8/2016 | Fellows | |
| 9,551,546 | B2 | 1/2017 | Aiicea, Jr. | |
| 9,658,017 | B2 | 5/2017 | Alicea, Jr. | |
| 10,030,928 | B2 | 7/2018 | Aiicea, Jr. | |
| 10,107,580 | B2 | 10/2018 | Fellows et al. | |
| 10,113,823 | B2 | 10/2018 | Alicea, Jr. | |
| 10,254,059 | B1 | 4/2019 | Fellows et al. | |
| 10,295,290 | B2 | 5/2019 | Fellows et al. | |
| 10,393,461 | B2 | 8/2019 | Fellows et al. | |
| 10,480,881 | B2 | 11/2019 | Fellows et al. | |
| 10,480,882 | B2 | 11/2019 | Fellows et al. | |
| 2006/0169268 | A1 | 8/2006 | Tippmann | |
| 2009/0255160 | A1 | 10/2009 | Summers | |
| 2010/0186277 | A1 | 7/2010 | Beckmann | |
| 2011/0061280 | A1 | 3/2011 | Emde | |
| 2011/0232618 | A1 | 9/2011 | Gabrel | |
| 2013/0019510 | A1 | 1/2013 | Kemmerer | |
| 2013/0019512 | A1 | 1/2013 | Kemmerer | |
| 2013/0118050 | A1 | 5/2013 | Alicea | |
| 2013/0125441 | A1 | 5/2013 | Westwood | |
| 2013/0167423 | A1 | 7/2013 | Lupher | |
| 2013/0180147 | A1 | 7/2013 | Lupher | |
| 2015/0198402 | A1 | 7/2015 | Brace | |
| 2015/0241156 | A1* | 8/2015 | Alicea, Jr. | F41A 17/06 89/28.1 |
| 2016/0018176 | A1 | 1/2016 | Fellows et al. | |
| 2016/0084599 | A1* | 3/2016 | Alicea, Jr. | F41A 17/46 42/70.06 |
| 2016/0084601 | A1 | 3/2016 | Alicea, Jr. | |
| 2017/0122686 | A1 | 5/2017 | Fellows et al. | |
| 2018/0321007 | A1 | 11/2018 | Aiicea, Jr. | |

* cited by examiner

ELECTRONIC FIREARM

CROSS-REFERENCE TO RELATED APPLICATION

The present application is a divisional of U.S. patent application Ser. No. 14/818,638 filed on Aug. 5, 2015, which claims the benefit of the filing date of U.S. Provisional Application No. 62/033,405 filed on Aug. 5, 2014, each of which is incorporated herein by reference in its entirety.

BACKGROUND

Firearms typically rely on mechanical systems to control the firing of projectiles from the firearm. When firearms employ multiple firing modes, the complexity of the mechanical systems increase, and in some cases certain firing modes are not possible or feasible due to the mechanical complexity involved. In addition to increasing the number of components involved in the firing, the potential for failure increases due to wear and malfunction of the components.

Firearms with electronic systems present an opportunity to reduce the mechanical complexity of firearms, particularly those with multiple firing modes. However, despite the shortcomings of mechanical systems, electronically operated firing systems for firearms have not been widely adopted due to perceived shortcomings with electronically operated firing systems. Therefore, further improvements in this area are needed.

SUMMARY

There is disclosed herein systems, methods and apparatus relating to a firearm with an electronically operable firing system to fire projectiles from the firearm. In one embodiment, the systems, methods and apparatus include firing mechanisms for mechanically and electronically firing a firearm. In another embodiment, the systems, methods and apparatus include a selector mechanism for selecting a safe mode, an electronic firing mode or a mechanical firing mode for the firearm is disclosed. In yet another embodiment, the systems, methods and apparatus include an electronic controller and shooter interface for controlling firing of a firearm in an electronic mode of firing.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

FIG. 12 is the cutaway perspective view of the lower receiver/grip assembly of FIG. 11 with the electronic actuator turned on.

19-21 with the safety selector positioned to place the firearm in an electronic firing mode, and with the trigger pulled from a first position where the first switch is disengaged to a second position where the first switch is engaged.

Figure 19:
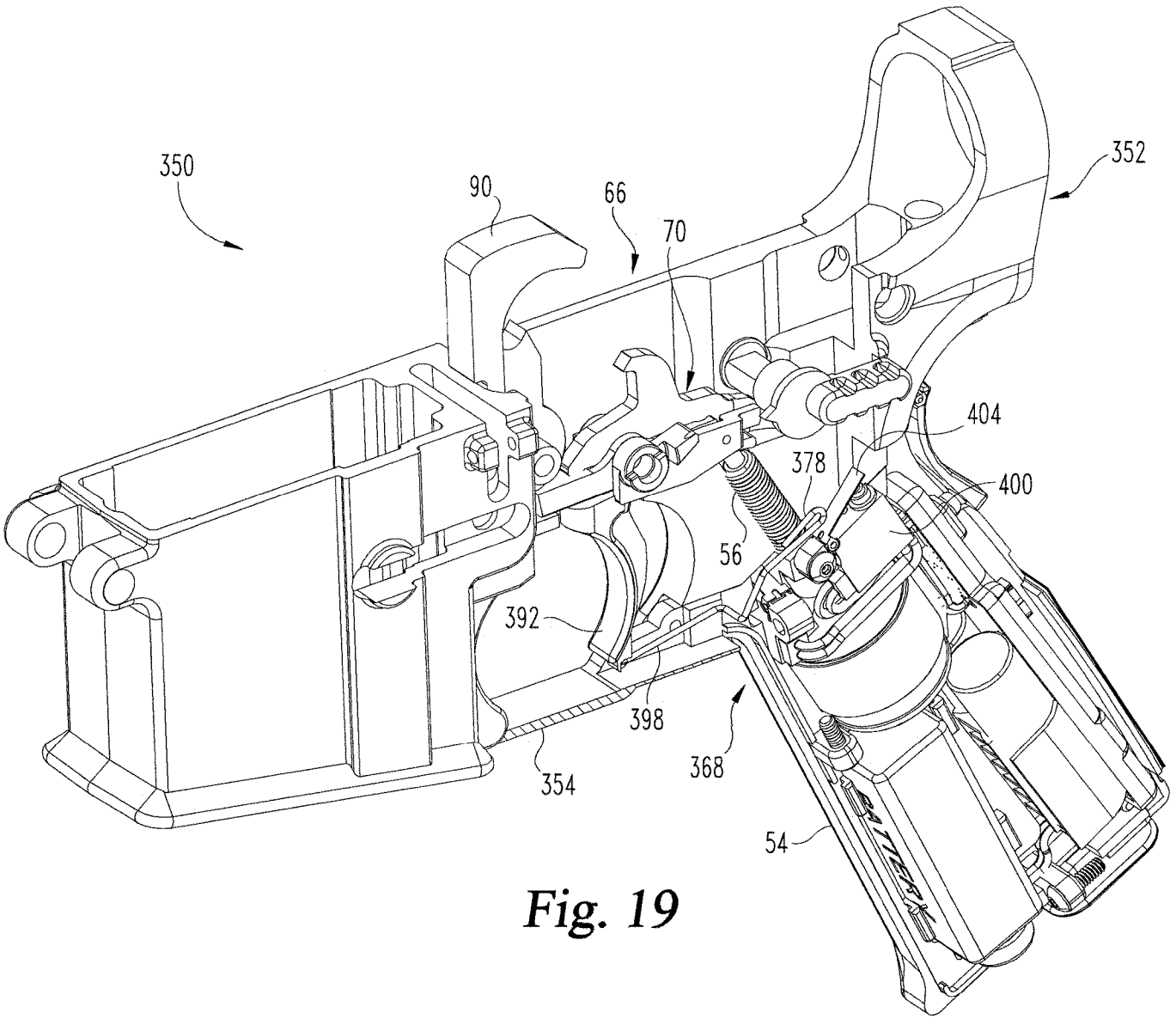
FIG. 19 is a perspective cutaway view in partial section of another embodiment of the lower receiver/grip assembly of FIG. 1.
Figure 20:
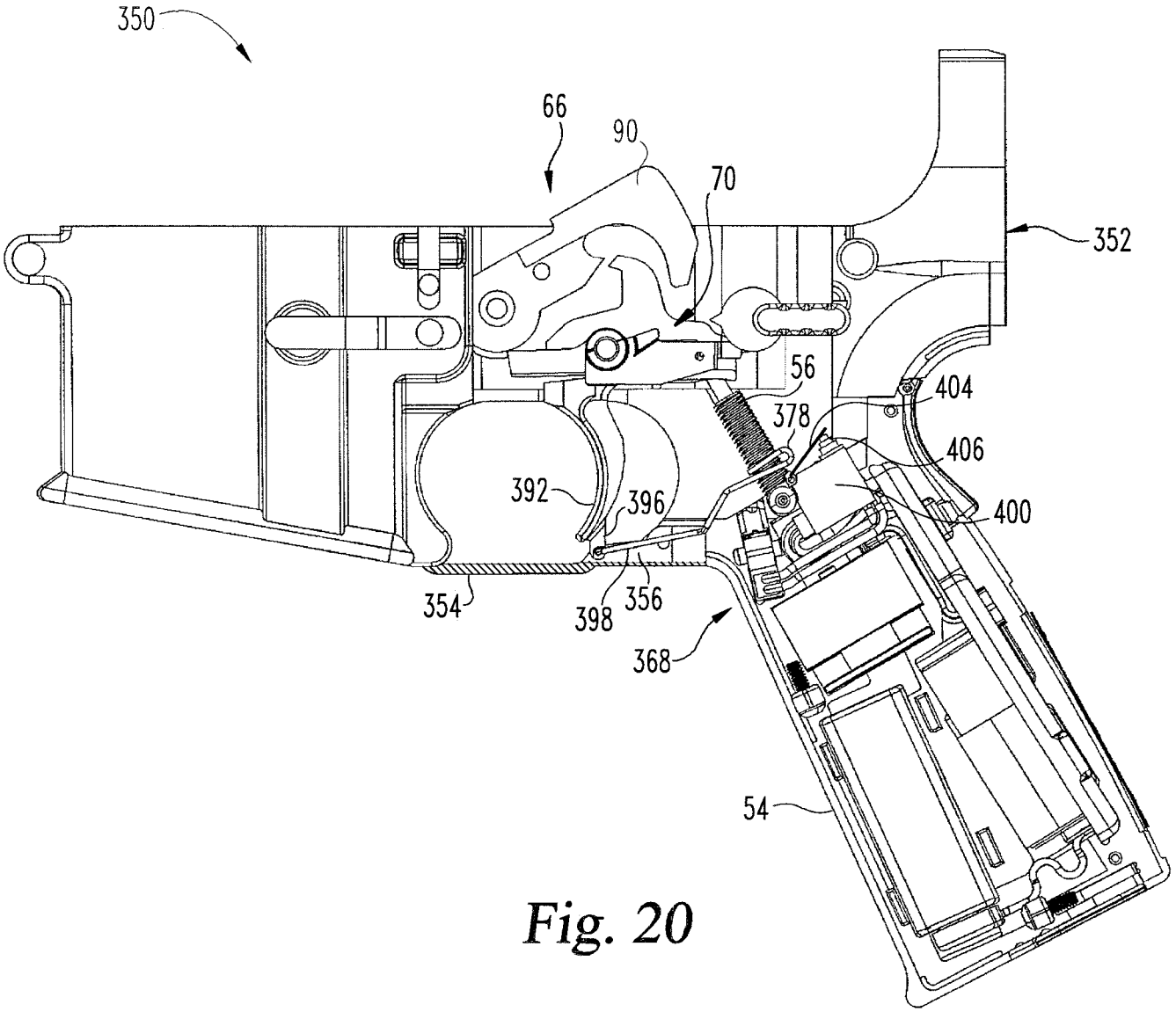
FIG. 20 is a side elevation cutaway view in partial section of the lower receiver/grip assembly of FIG. 19.
Figure 21:
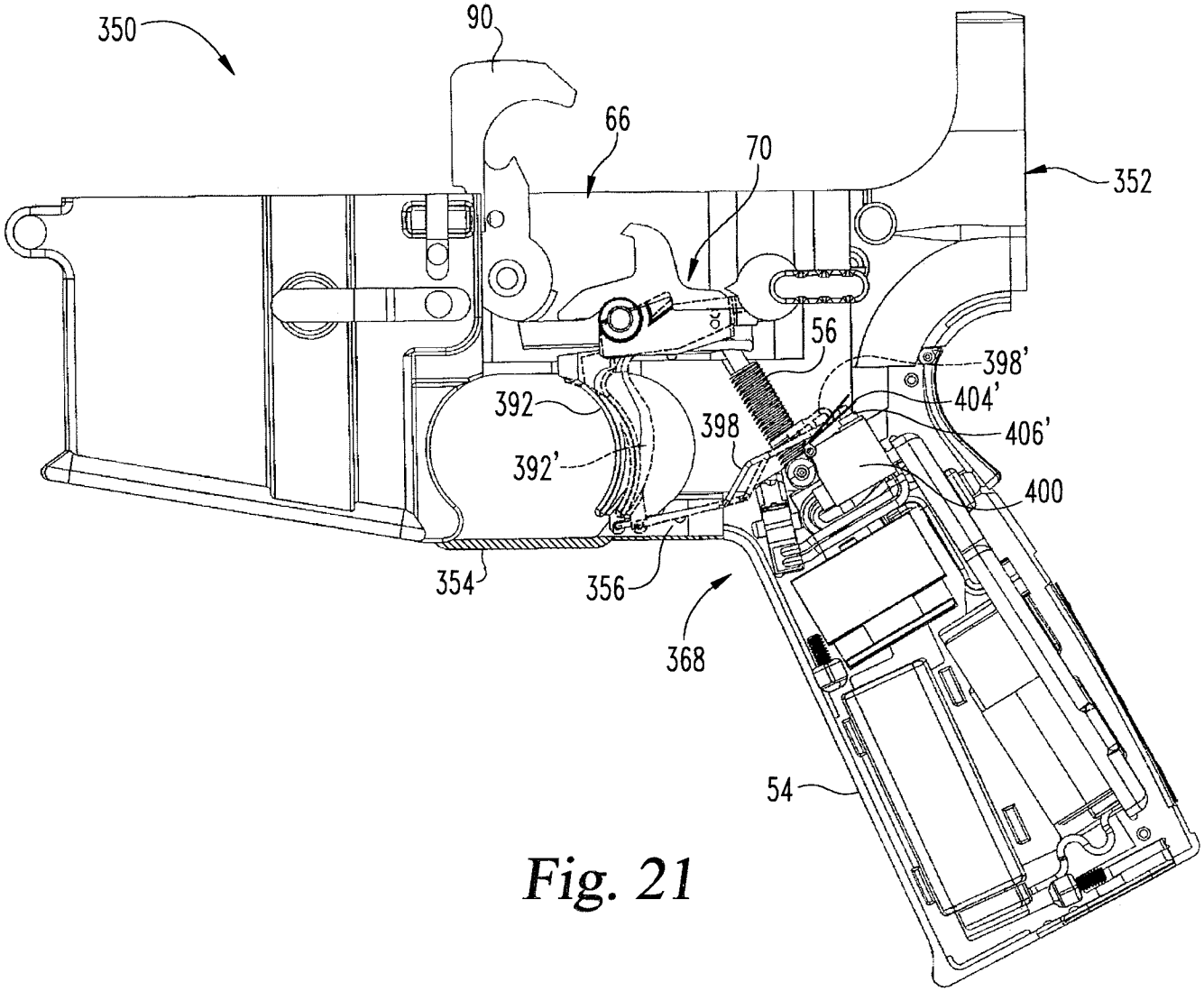
FIG. 21 is the side elevation cutaway view in partial section of FIG. 20 with the trigger switch engaged.
Figure 26:
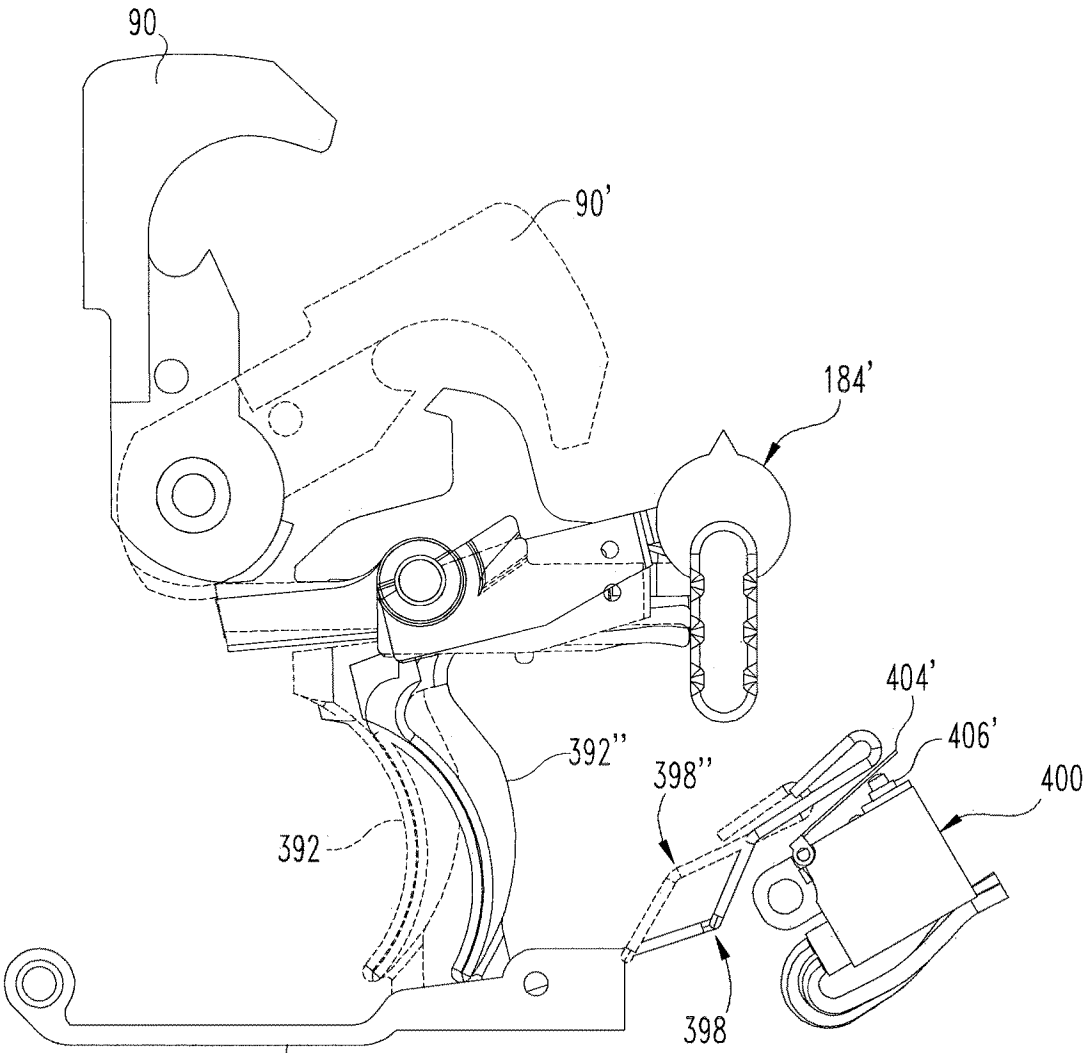

FIG. 26 is a side elevational view showing the trigger group and the first switch of the embodiments of FIGS. 19-21 with the safety selector positioned to place the firearm in a mechanical firing mode, and with the trigger pulled from a first position where the first switch is disengaged to a second position where the first switch is engaged.

DESCRIPTION THE ILLUSTRATED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIGS. 1-6, there is shown a firearm 50 that includes a lower receiver 52 and a grip assembly 54 secured to lower receiver 52 with a fastening member 56. It should be understood that not all details of firearm 50 are shown, such as its upper receiver, bolt assembly and barrel, it being understood that the present disclosure has application to any suitable upper receiver and barrel for a firearm. In one embodiment, firearm 50 is an AR-15 or M16 type firearm, although other firearm types are also contemplated, with a mechanical firing system 66 generally associated with lower receiver 52 and an electronic firing system 68 generally associated with grip 54. As discussed further below, electronic firing system 68 is structured to selectively interface with and operate mechanical firing system 66 in an electronic firing mode of firearm 50.

Figure 4:
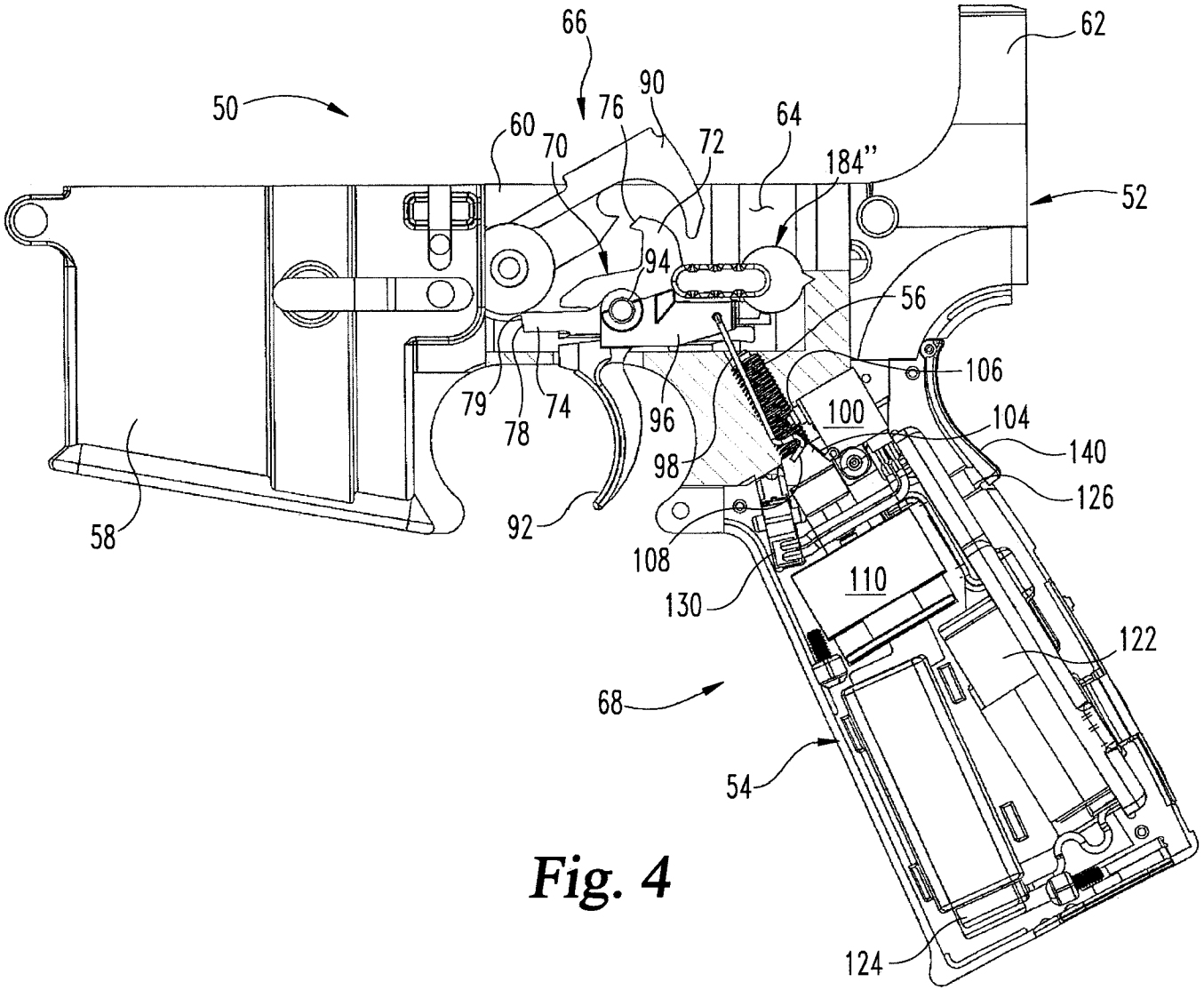
FIG. 4 is the side elevation cutaway view in partial section of the lower receiver/grip assembly of FIG. 3 with the trigger switch disengaged.
Figure 5:
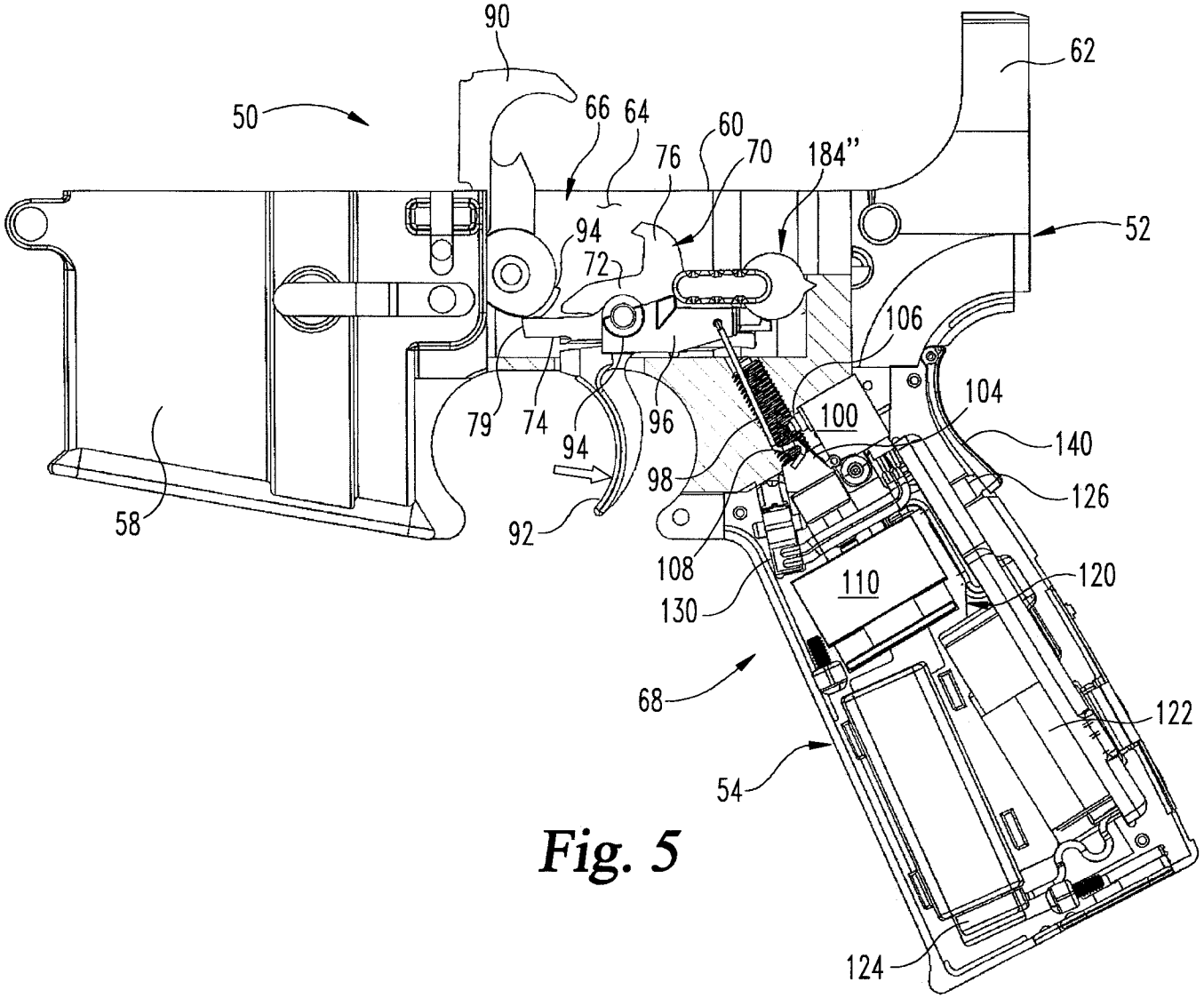
FIG. 5 is the side elevation cutaway view in partial section of FIG. 4 with the trigger switch engaged.

Lower receiver 52 of firearm 50 includes a magazine holder 58 for receiving a magazine (not shown) and a housing 60 with a buffer tube or stock assembly attachment member 62 at a rearward end thereof. Housing 60 defines a compartment 64 for housing at least a portion of mechanical firing system 66, such as a sear assembly 70 and a hammer 90. A trigger 92 is coupled to sear assembly 70 with a pin arrangement 94, which also couples sear assembly 70 to lower receiver 52. Hammer 90 is movable between a cocked position, such as shown in FIG. 4, to a released position by pulling of trigger 92, such as shown in FIG. 5.

Sear assembly 70 includes a disconnector or upper sear 72 and a lower sear 74 pivotal relative to upper sear 72 about pin arrangement 94. Upper sear 72 includes a hammer engagement member 76 that releaseably retains hammer 90 in a cocked position while trigger 92 is depressed during mechanical firing to provide time for the spent cartridge to be ejected and the next cartridge to be cycled into the firing chamber (not shown) of the upper receiver. Lower sear 74 includes a hammer engagement surface 78 to engage a sear engagement surface 79 of hammer 90 to hold hammer 90 in a cocked position until lower sear 74 is pivoted out of an engagement position by pulling trigger 92. As discussed further below, lower sear 74 can be pivoted to release hammer 90 in response to a manual pull of trigger 92 by a first amount that is sufficient to disconnect engagement surfaces 78, 79 in a mechanical firing mode, or pivoted in response to operation of an electronic actuator of electronic firing system 68 that is activated by a manual pull of trigger 92 a second amount that actuates the electronic actuator. In certain embodiments, the second amount is less than the first amount so that in an electronic firing mode the pull of the trigger 92 actuates the electronic actuator before disconnecting engagement surfaces 78, 79, but in the event of electronic failure a continuation of the trigger pull mechanically fires the firearm 50.

Trigger 92 includes a trigger arm 96 extending rearwardly from pin arrangement 94 that is connected at its rearward end to a trigger lever 98. Trigger lever 98 extends into grip 54 from trigger arm 96 toward a first switch 100, and is supported on a dowel 102 for sliding movement therealong in response to pulling and releasing of trigger 92, which raises and lowers the rearward end of trigger arm 96. Trigger lever 98 includes a U-shaped engagement end portion 108 that rides along a flexible actuator 104 that is in engagement with a button 106 of first switch 100. In the position shown in FIGS. 3-4, engagement end portion 108 resides below button 106 so that button 106 projects fully outwardly from first switch 100. When trigger 92 is pulled, as shown in FIG. 5, trigger arm 96 pivots upwardly, which pulls trigger lever 98 upwardly along grip 54 and pulls its U-shaped engagement end portion 108 along flexible actuator 104, which in turn depresses button 106 of switch 100 to actuate an electronic actuator 110 of electronic firing system 68, as discussed further below.

Switch 100 is electrically connected to an electronic circuit 120 which controls electronic actuator 110 to fire firearm 50 in an electronic firing mode. Electronic circuit 120 includes a programmable printed circuit board 122 connected to electronic actuator 110 and a power source 124, such as batteries, connected to printed circuit board 122. First switch 100 is operable by trigger 92 to operate electronic actuator 110 when the electronic firing system 68 is turned on by a second switch 130 that is moveable between an on position and an off position. As discussed further below, second switch 130 is operable by a selector mechanism that allows the user or shooter to select the on and off positions. First switch 100 and second switch 130 are connected to printed circuit board 122 to allow the user or shooter to selectively control the electronic firing system 68 of firearm 50. Grip 54 further includes a grip safety 140 that is pivotally mounted to a rearward side of grip 54. Grip safety 140 includes a nub 142 that engages a third switch 126 of printed circuit board 122 to enable an electronic firing mode of firearm 50 with trigger 92 and electronic actuator 110 when grip safety 140 is depressed by the shooter and when second switch 130 is on.

Figure 6:
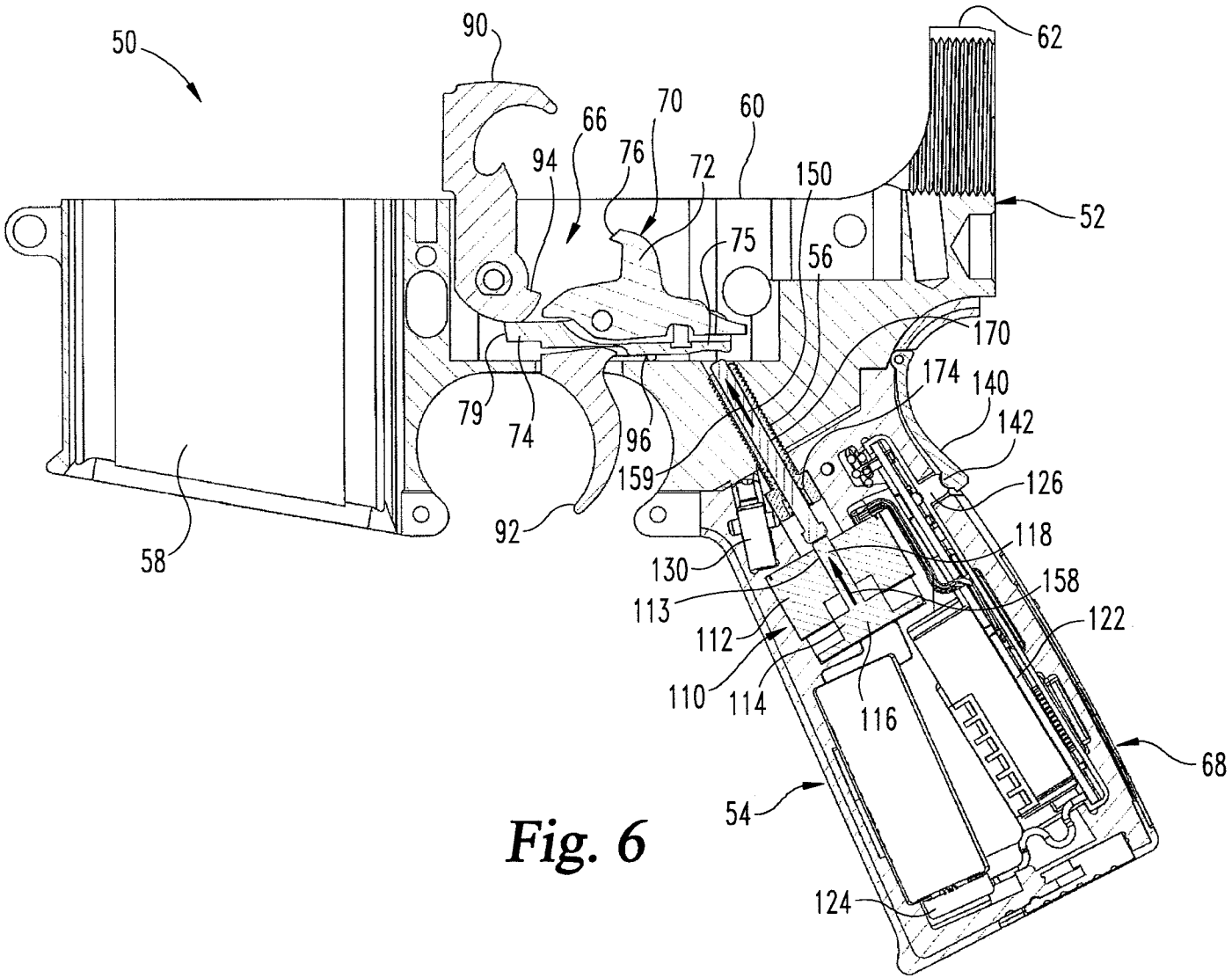
FIG. 6 is a sectional view of the lower receiver/grip assembly of FIG. 1 showing the electronic and mechanical firing systems and attachment of the grip to the lower receiver.
Figure 8:
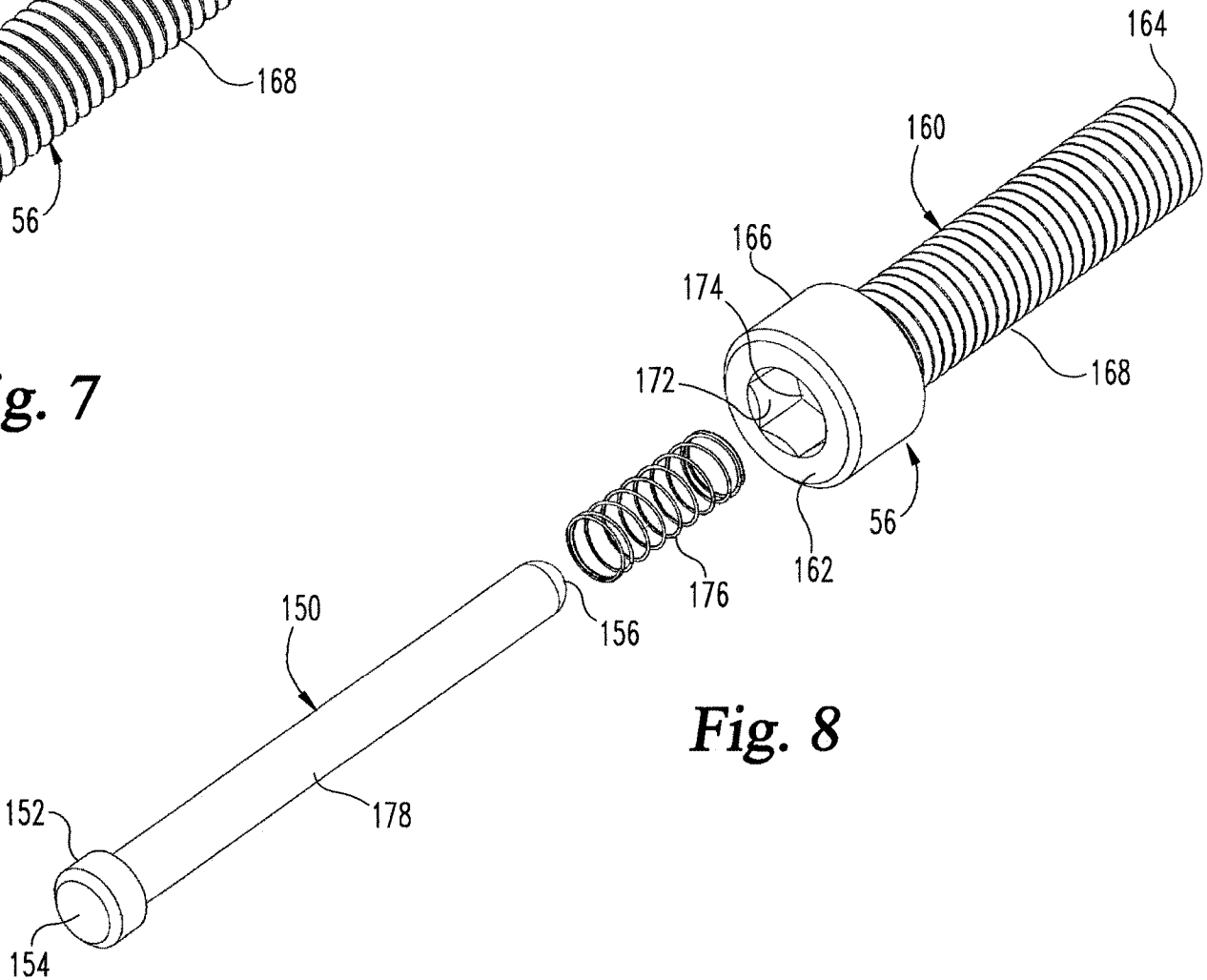
FIG. 8 is an exploded perspective view of the fastening member and sear displacement member of FIG. 7.
Figure 7:
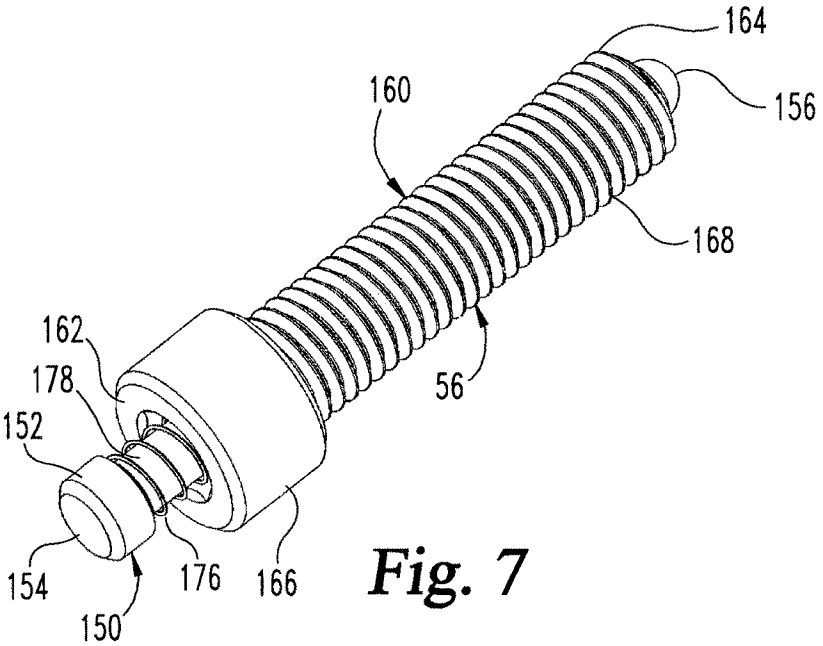
FIG. 7 is a perspective view of a fastening member for securing the grip to the lower receiver and a sear displacement member through the fastening member.

Referring now to FIG. 6, lower receiver 52 and grip 54 are shown in section with the interface between electronic firing system 68 and mechanical firing system 66. In the illustrated embodiment, electronic actuator 110 includes a solenoid 112 and an actuating member 114 that is linearly moveable in response to activation of solenoid 112. Actuating member 114 includes an end member 116 and an elongated shaft 118 extending from end member 116 through a longitudinal bore 113 of solenoid 112. The end of shaft 118 opposite end member 116 engages a flange 152 at a first end 154 of a sear displacement member 150, shown further in FIGS. 7-10. Sear displacement member 150 extends through fastening member 56 to a second end 156 that engages, either directly or indirectly, a rearward end portion 75 of lower sear 74. As actuating member 114 moves in the direction of arrow 158 in solenoid 112, it pushes on flange 152 to drive sear displacement member 150 longitudinally relative to fastening member 56 in the direction of arrow 159 and into contact with end portion 75, which in turn pivots lower sear 74 to release trigger engagement surface 78 from sear engagement surface 79 of hammer 90, releasing hammer 90 from the cocked position to electronically fire the firearm.

Referring further to FIGS. 7-10, further details of sear displacement member 150 and its arrangement relative to fastening member 56 are shown. Fastening member 56 includes an elongated body 160 extending between a first end 162 and an opposite second end 164. Adjacent first end 162 fastening member 56 includes a head 166, and a threaded shaft 168 extends from head 166 to second end 164. Body 160 further defines a longitudinal bore 170 (FIG. 6) that extends between and opens at first end 162 and second end 164. In the illustrated embodiment, head 166 includes an internal hex profile 172 to receive and engage a driving tool to drive fastening member 56 through grip 54 and into a threaded bore in lower receiver 52 to secure grip 54 to lower receiver 52. In addition, a lip 174 in head 166 extends around bore 170 to provide a support platform for spring 176.

Figure 9:
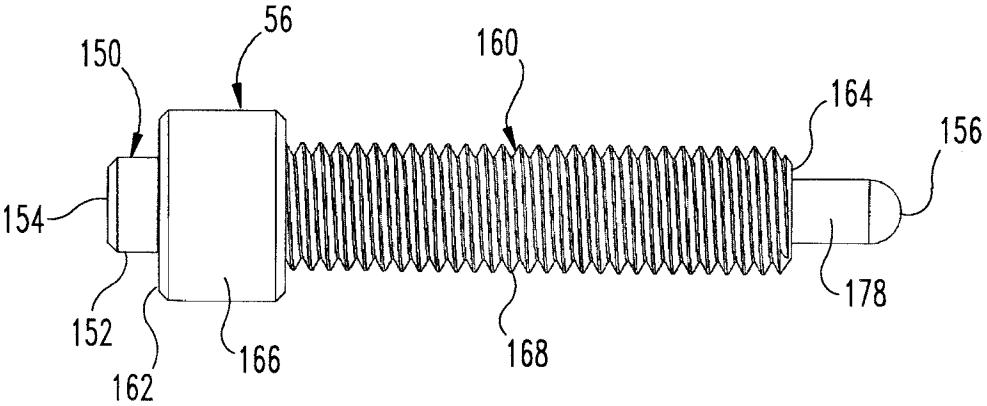
FIG. 9 is an elevation view of the fastening member and sear displacement member of FIG. 7 with the sear displacement member in a sear displacement position.
Figure 10:
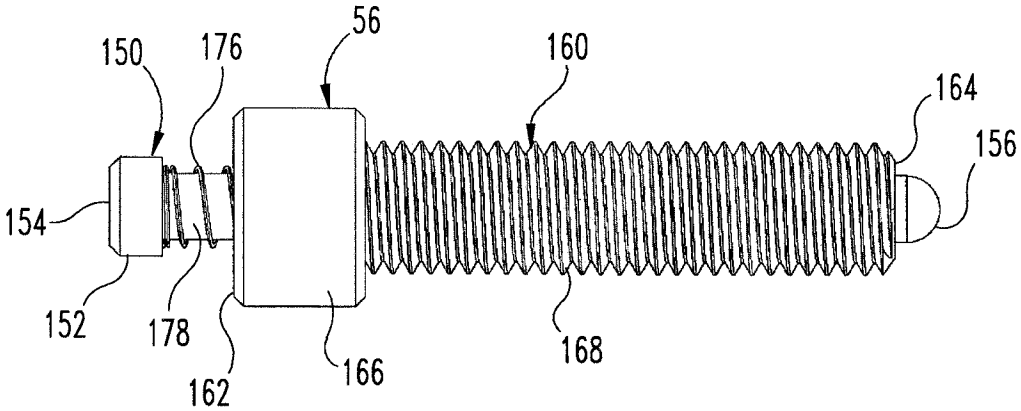
FIG. 10 is an elevation view of the fastening member and sear displacement member of FIG. 7 with the sear displacement member retracted from the sear displacement position.

Sear displacement member 150 includes a rod-like shaft 178 extending from flange 152 to second end 156 of sear displacement member 150. Spring 176 is positioned around shaft 178 in abutting engagement between flange 152 and lip 174 of fastening member 56 so that sear displacement member 150 is normally biased to the position in FIGS. 6 and 10, in which flange 152 is spaced a first distance from head 166 and second end 156 projects slightly outwardly from second end 164 of fastening member 56. When trigger 92 is pulled to activate first switch 100, solenoid 112 is energized and sear displacement member 150 is pushed by the longitudinal displacement of actuating member 114 toward rearward end portion 75 of lower sear 74, overcoming the force of spring 176 and compressing spring 176 as flange 152 moves toward head 166, causing second end 156 of sear displacement member 150 to move away and outwardly from second end 164 of fastening member 56, as shown in FIG. 9. Second end 156 contacts end portion 75 of lower sear 74, either directly or indirectly through an intervening member, to release lower sear 74 from hammer 90 when in the cocked position. When solenoid 112 is de-energized, spring 176 forces sear displacement member 150 and actuating member 114 back to the position of FIGS. 6 and 10.

In the illustrated embodiment, sear displacement member 150 and actuating member 114 are separate members, but other embodiments contemplate they could be combined as a single member, or provided as more than two members. Furthermore, although fastening member 56 is shown with a threaded shaft 168, a threaded engagement between fastening member 56 and lower receiver 52 is not required. Any suitable fastening arrangement is contemplated. In still other embodiments, sear displacement member 150 does not extend through a fastening member that fastens grip 54 to lower receiver 52, and any suitable fastening member secured to at least one of lower receiver 52 and grip 54 which defines a travel path for sear displacement member 150 is contemplated.

Referring back to FIGS. 1-5, a safety selector 184 of a selection mechanism 220 (FIGS. 16-18) is shown rotatably mounted to lower receiver 52. Safety selector 184 is moveable between a safety position in which sear assembly 70 is blocked to prevent mechanical firing mode of operation and in which second switch 130 is off to prevent an electronic firing mode of operation, a mechanical firing mode position 184' in which the sear assembly 70 is not blocked and a mechanical firing mode is enabled but in which second switch 130 is off and the electronic firing mode is disabled, and an electronic firing mode position 184" in which second switch 130 is on to enable an electronic firing mode of operation. Lower receiver 52 includes first and projections 186*a*, 186*b* to limit movement of safety selector 184 from the safety position to the electronic firing mode position, with the mechanical firing mode position 184' being between the safety position of safety selector 184 and the electronic firing mode position 184".

Figure 11:
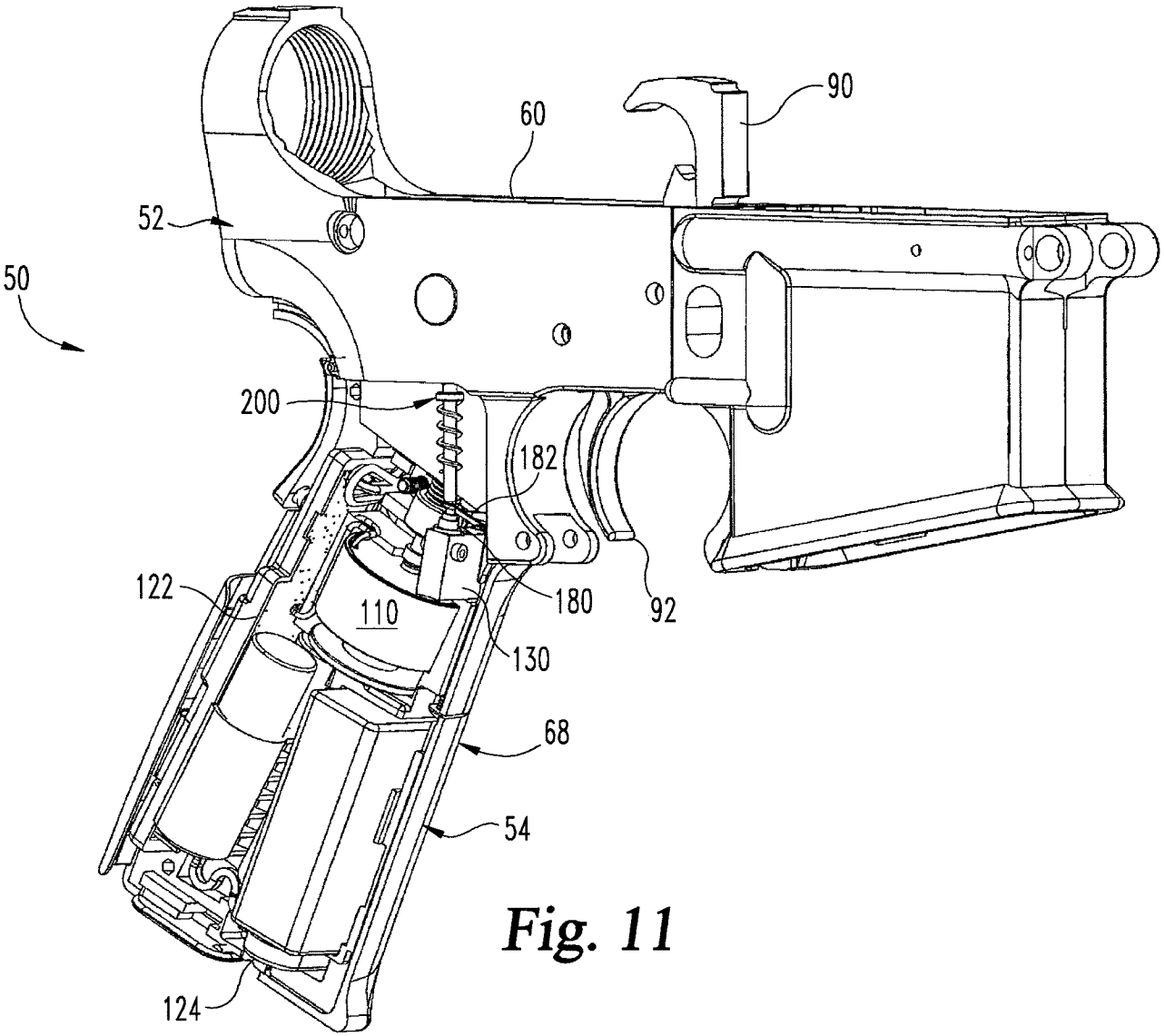
FIG. 11 is another cutaway perspective view of the lower receiver/grip assembly of FIG. 1 with an electronic actuator of the electronic firing system turned off.
Figure 12:
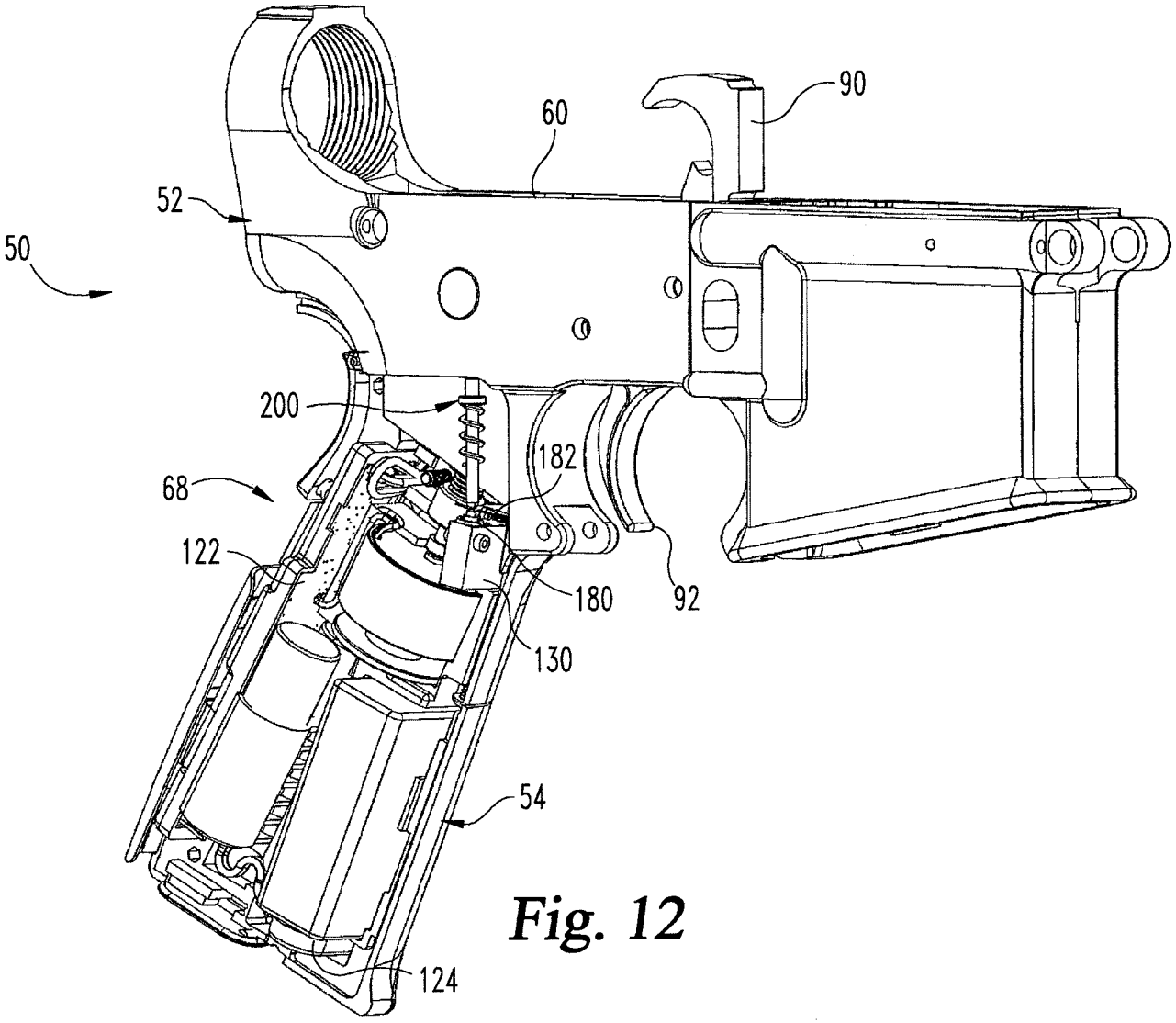
Figure 13:
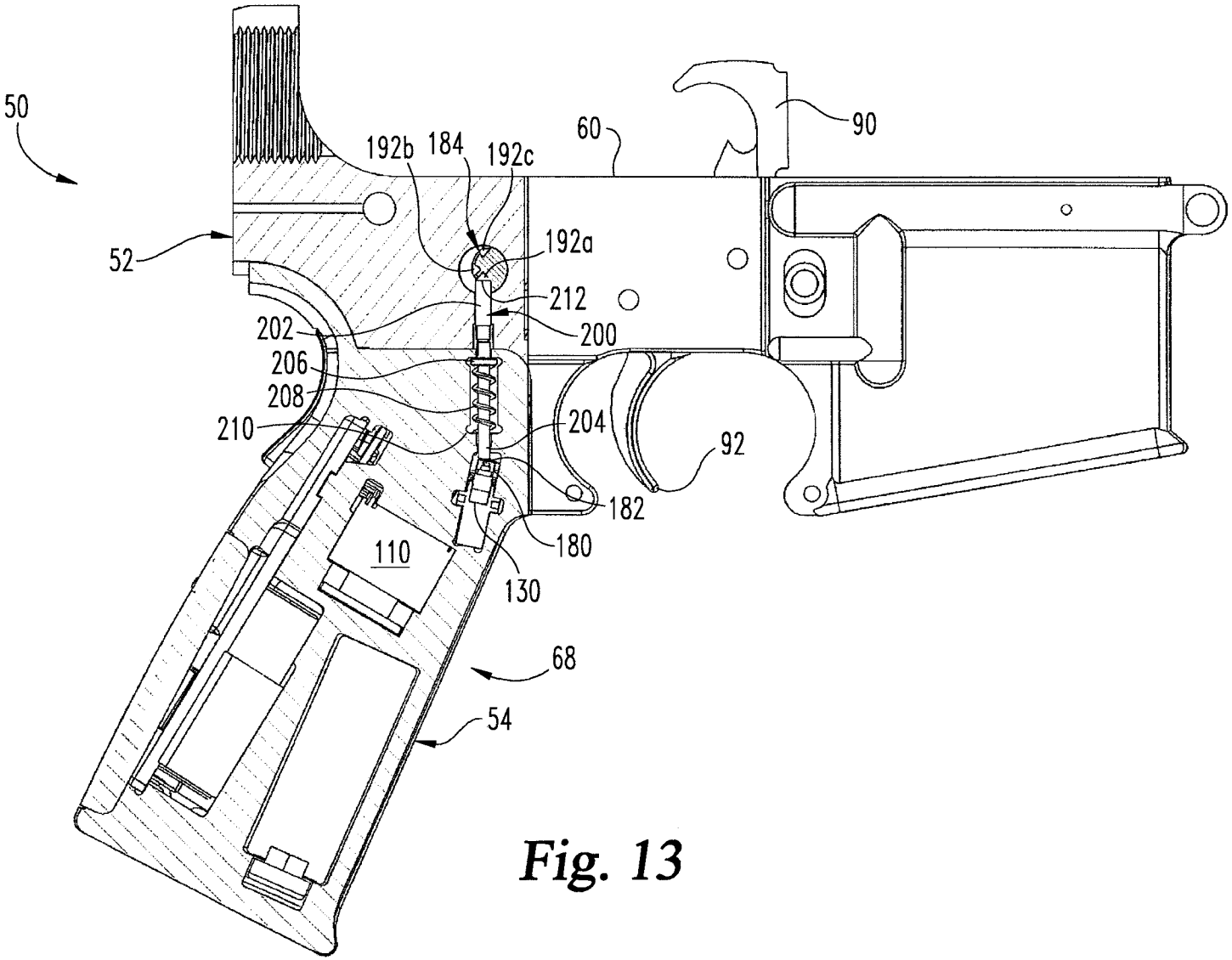
FIG. 13 is a sectional view of the lower receiver/grip assembly of FIG. 11 with a safety selector positioned to turn the electronic actuator off and to place the firearm in a safe mode.
Figure 14:
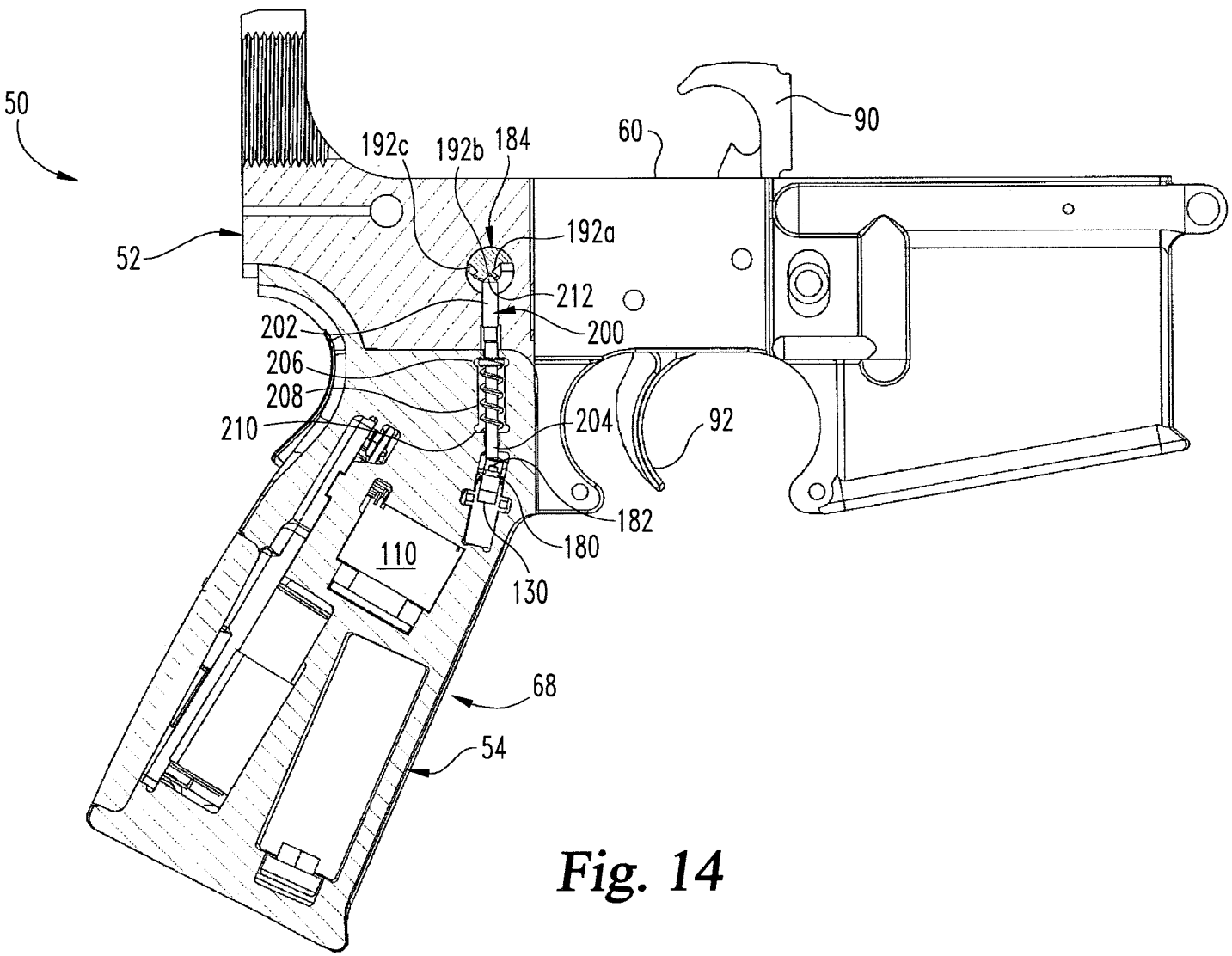
FIG. 14 is a sectional view of the lower receiver/grip assembly of FIG. 11 with the safety selector positioned to turn the electronic actuator off and to place the firearm in a mechanical firing mode.

Referring to FIGS. 11-15, further details of the selector mechanism 220 including safety selector 184 and its arrangement relative to lower receiver 52 and grip 54 are shown. The selector mechanism 220 includes a detent mechanism 200 that is engaged to safety selector 184 and to a second flexible actuator 182 associated with second switch 130. Second flexible actuator 182 is in contact with a second button 180 of second switch 130. As shown in FIGS. 11, 13 and 14, when safety selector 184 is in one of the safety position and the mechanical firing mode position, second button 180 is not depressed (i.e. in an off position) so that the electronic firing system 68 is not activated by pulling trigger 92 to depress button 106 of switch 100, preventing an electronic mode of firing. When safety selector 184 is moved to the electronic firing mode position of FIGS. 12 and 15, detent mechanism 200 pushes on second flexible actuator 182 which in turn depresses second button 180 of second switch 130, which in turn activates the electronic firing system 68 associated with electronic actuator 110 and enables an electronic mode of firing by pulling trigger 92 to depress button 106 of switch 100.

Figure 18:
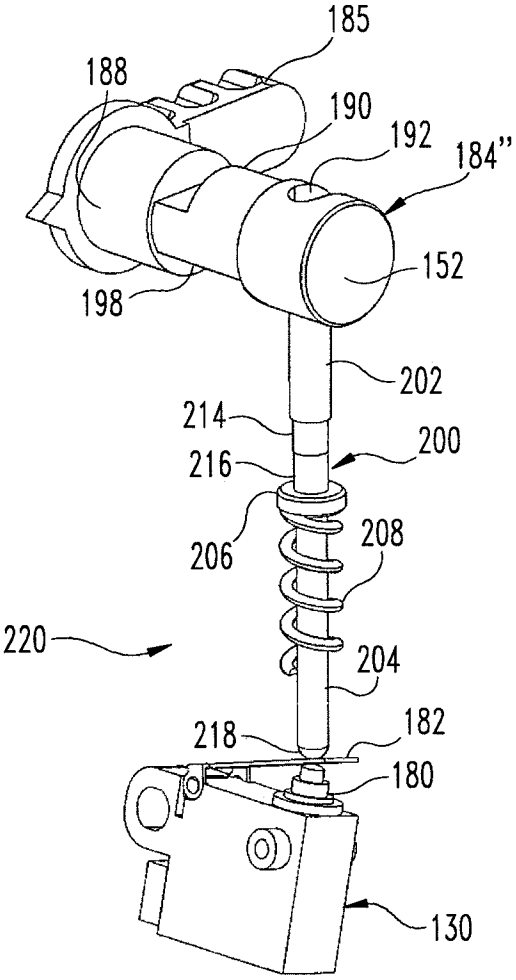
FIG. 18 is another perspective view showing the safety selector and the on/off switch for the electronic actuator with the on/off switch in an on position and the safety selector positioned for placing the firearm in an electronic firing mode.
Figure 17:
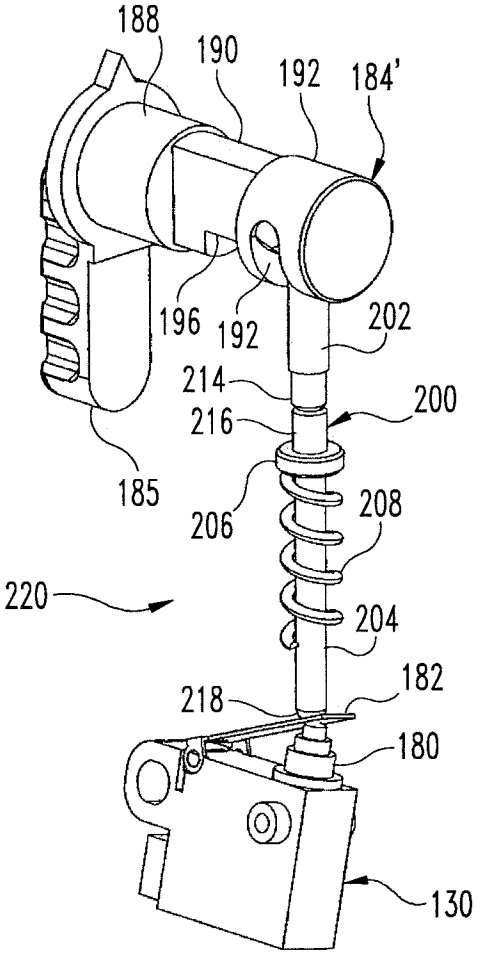
FIG. 17 is another perspective view showing the safety selector and the on/off switch for the electronic actuator with the on/off switch in an off position and the safety selector positioned to place the firearm in a mechanical firing mode.
Figure 16:
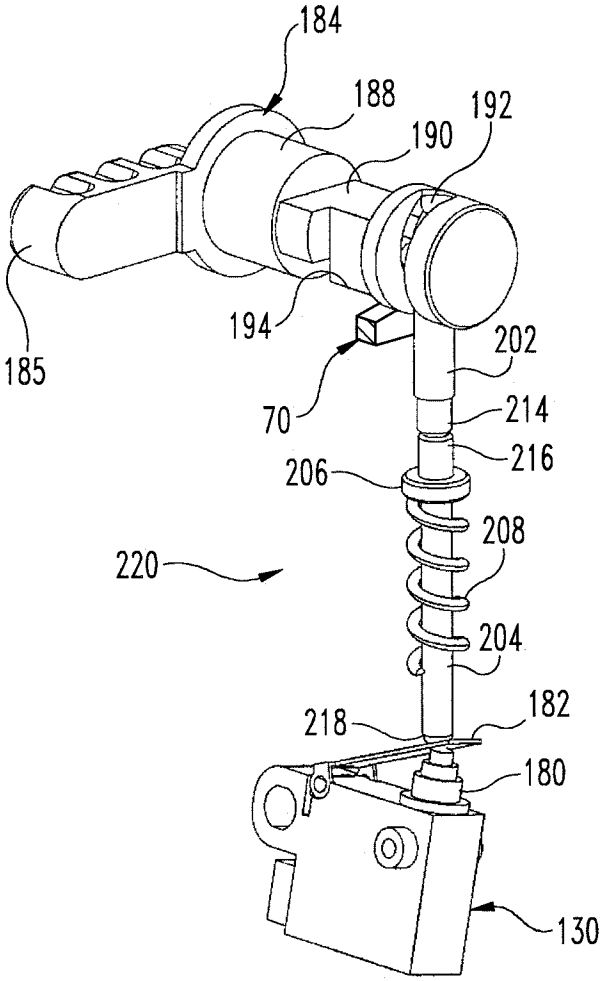
FIG. 16 is a perspective view showing the safety selector and an on/off switch for the electronic actuator with the on/off switch in an off position and the safety selector positioned to place the firearm in a safe mode.

Referring further to FIGS. 16-18, selector mechanism 220 is shown in isolation from lower receiver 52 and grip 54 for clarity. Safety selector 184 includes a thumb lever 185 that is accessible by the shooter to position safety selector 184 to the desired position. A cylindrical post portion 188 extends from thumb lever 185 so that post portion 188 that resides in a bore in lower receiver 52 to rotatably secure safety selector 184 to lower receiver 52. A first cam region 190 extends from post portion 188 to a second cam region 192 located at an end of safety selector 184. First cam region 190 includes a safety surface portion 194 that projects outwardly to engage sear assembly 70 when safety selector 184 is in the safe position, as shown in FIG. 16. By blocking pivoting movement of sear assembly 70, sear assembly 70 cannot be disengaged from hammer 90 by pulling trigger 92 or dropping or jarring firearm 50, even if hammer 90 is in the cocked position. Furthermore, in one embodiment, sear assembly 70 cannot pivot to allow movement of hammer 90 from the uncocked position to the cocked position when safety selector 184 is in the safety position. However, in another embodiment hammer 90 can be cocked and uncocked when safety selector 184 is in the safety position. When safety selector 184 is moved from the safety position, such as shown in FIGS. 17 and 18, first cam region 190 is configured to be spaced from sear assembly 70, and a first recessed surface portion 196 (FIG. 17) or a second recessed surface portion 198 (FIG. 18) are positioned relative to sear assembly 70 to allow sear assembly 70 to pivot to operate the firearm 50 in either of the mechanical firing mode or the electronic firing mode. However, in the electronic firing mode, upper sear 72 is allowed to pivot in response to a pull of trigger 92 to cause hammer 90 to engage with hammer engagement member 76, which would prevent a fully automatic or burst mode operations when in the electronic firing mode.

Figure 15:
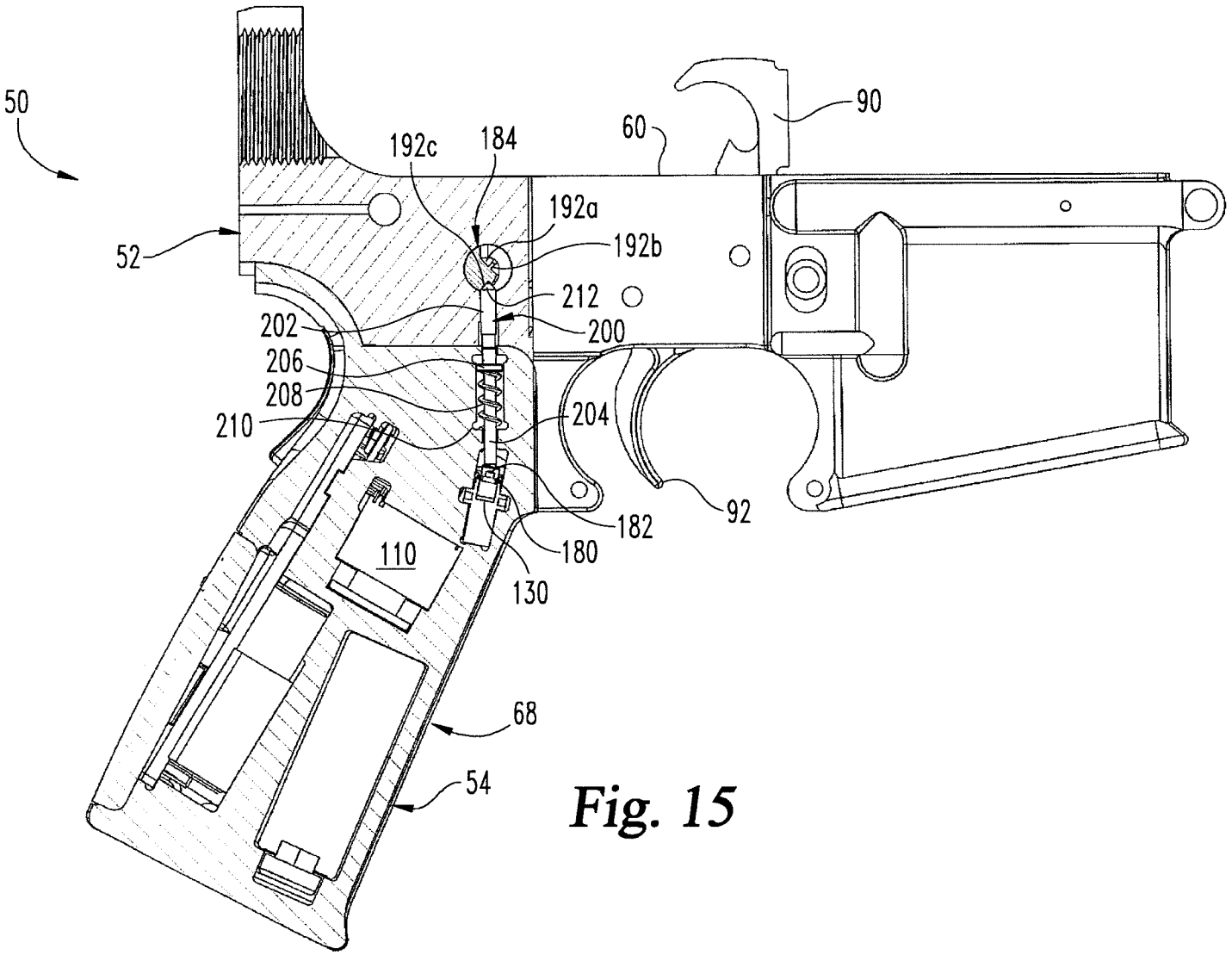
FIG. 15 is a sectional view of the lower receiver/grip assembly of FIG. 11 with the safety selector positioned to turn the electronic actuator on and to place the firearm in an electronic firing mode.

Second cam region 192 includes three cam locations 192*a*, 192*b* and 192*c* with cam surfaces therebetween, as shown in FIGS. 13-15. Detent mechanism 200 is normally biased into engagement with second cam region 192 and rides along the cam surfaces as safety selector 184 is moved between the various selector positions at cam locations 192*a*, 192*b*, 192*c*. Detent mechanism 200 positively engages a respective one of the cam locations 192*a*, 192*b*, 192*c* when aligned therewith to provide a positive stop and an audible indication that a safety selector position has been reached.

Detent mechanism 200 includes a first rod member 202 and a second rod member 204 abuttingly engaged to one another in an end-to-end manner. First rod member 202 extends between a first end 212 that is engaged to second cam region 192, as shown in FIGS. 13-15, and a second end 214 abuttingly engaged to a first end 216 of second rod member 204. In the illustrated embodiment, first end 212 is tapered to provide a conical or frusto-conical shape that engages cam locations 192*a*, 192*b*, 192*c*. However, other shapes are contemplated, including a rounded or hemispherically shaped first end 212. Second rod member 204 extends between first end 216 and a second 218 that contacts second flexible actuator 182 of second switch 130. Second rod member 204 includes a flange 206 adjacent its first end 216, and a spring 208 extends around second rod member 204 and abuttingly engages flange 206 at a first end of spring 208 and abuttingly engages a support surface 210 in grip 54.

In the safety position of safety selector 184, spring 208 normally biases second end 218 of second rod member 204 away from second button 180 of second switch 130 so that second flexible actuator 182 does not depress second button 180, and first end 212 of first rod member 202 is positively engaged to second cam region 192 at cam location 192*a*, as shown in FIG. 13. Cam location 192*a* is spaced from flexible actuator 182 a sufficient distance so that second 218 of second rod member 204 is positioned to avoid depressing second button 180. When safety selector 184 is rotated from the safety position to the mechanical mode firing position 184', first end 212 of first rod 202 is biased by spring 208 to engage second cam region 192 at a second cam location 192*b*, as shown in FIG. 14, which is also spaced from second flexible actuator 182 a sufficient distance to avoid second end 218 of second rod member 204 from depressing second button 180 of second switch 130. When safety selector 184 is rotated from the mechanical firing mode position 184' to the electronic firing mode position 184", first end 212 of first rod member 202 is biased by spring 208 to engage second cam region 192 at a third cam location 192*c*, as shown in FIG. 15, which is spaced from second flexible actuator 182 a lesser distance so that spring 208 is compressed between flange 206 and support surface 210, which in turn pushes second end 218 of second rod member 204 against second flexible actuator 182 to depress second button 180 of second switch 130. Depressing second button 180 enables electronic firing system 68 to operate electronic actuator 110 in response to pulling of trigger 92 to fire the firearm 50 electronically.

Referring to FIGS. 19-21, there is shown another embodiment firearm 350 that is similar to firearm 50 discussed above, but includes a modified trigger guard and trigger lever for actuating a first switch 400 that is re-positioned and/or re-oriented in the grip relative to first switch 100 discussed above, but otherwise functions identically thereto. Therefore, components and functioning of firearm 350 that are like or similar to components of firearm 50 are not re-described herein, it being understood, unless otherwise noted, that firearm 350 can be identical to firearm 50.

Firearm 350 includes a lower receiver 352 and a grip assembly 54 secured to lower receiver 352 with a fastening member 56. As discussed above with respect to electronic firing system 68 of firearm 50, firearm 350 includes an electronic firing system 368 is structured to selectively interface with and operate mechanical firing system 66 in an electronic firing mode of firearm 350. However, electronic firing system 368 includes a first switch 400 rotated 90 degrees clockwise in grip 54 from the orientation of first switch 100 in grip 54 of FIGS. 1-6. This orientation allows a trigger lever 398 attached to the lower or bottom end of trigger 392 to actuate switch 400 by pulling trigger 392 to a position shown in trigger 392' in FIG. 21, which causes trigger lever 398 to longitudinally displace in a direction paralleling the direction defined by the trigger pull (i.e. a rearward direction), rather than being displaced in a direction transverse to the direction of the trigger pull (i.e. a downward direction) like trigger lever 98 discussed above.

Figure 22:
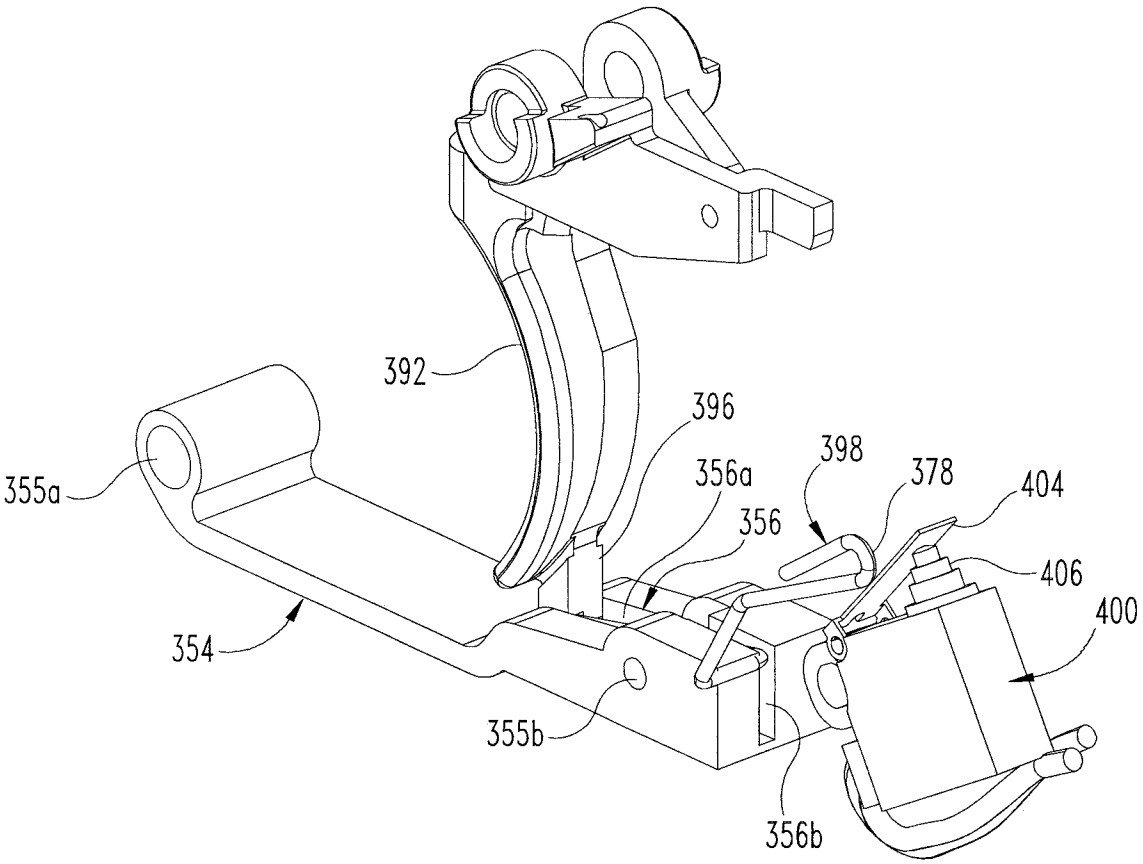
FIG. 22 is a perspective view showing a part of the trigger group and the first switch of the embodiments of FIGS. 19-21.
Figure 23:
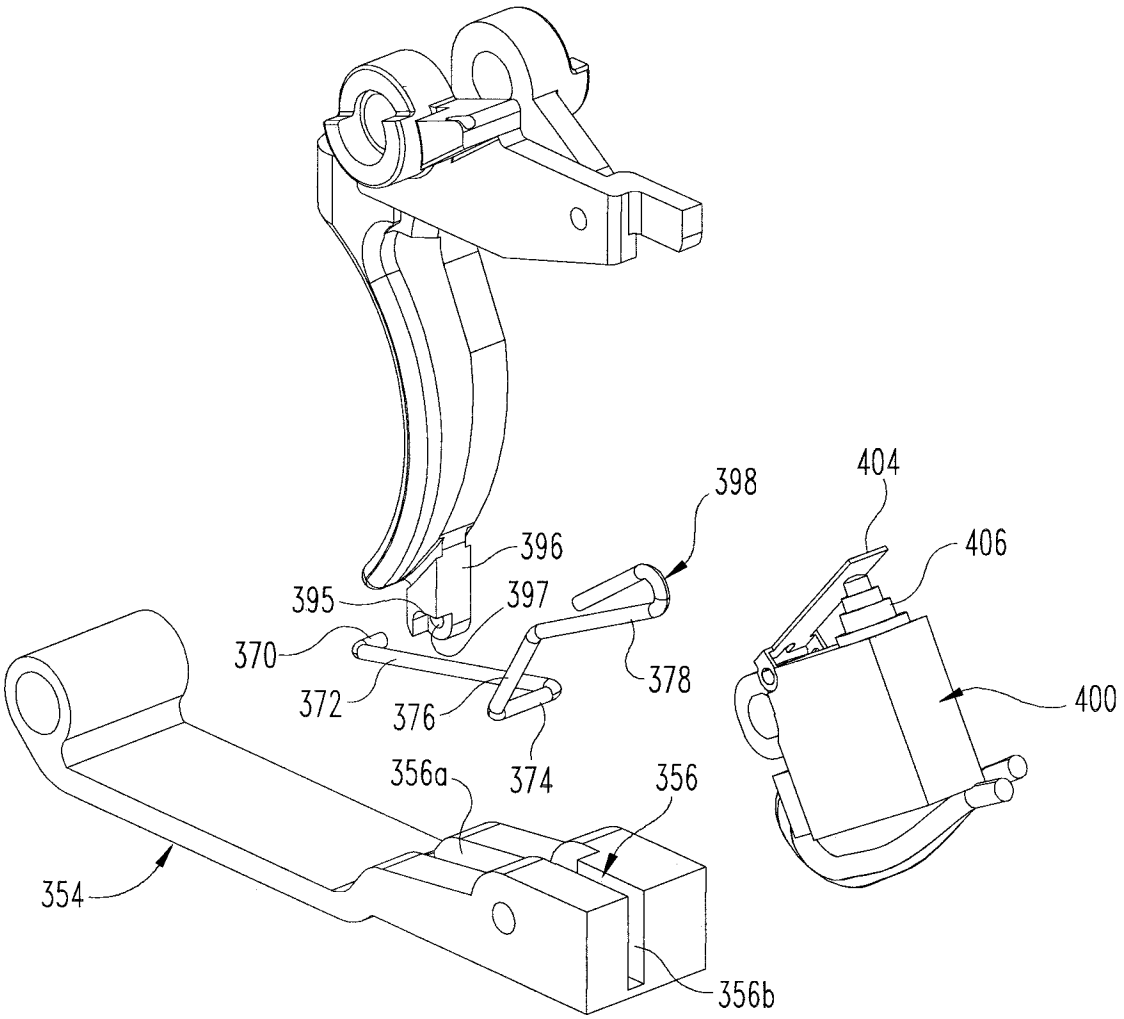
FIG. 23 is an exploded perspective view showing the trigger group and first switch of FIG. 22.

Referring further to FIGS. 22-23 in addition to FIGS. 19-21, lower receiver 352 includes a removable trigger guard 354, shown in a longitudinal section view in FIGS. 19-21. Trigger guard 354 includes apertures 355*a*, 355*b* at opposite ends thereof to receive fasteners to removably secure trigger guard 354 to lower receiver 352. Trigger 392 includes a trigger arm 396 extending downwardly therefrom and into a first wider part 356*a* of a longitudinal slot 356 defined by trigger guard 354. Trigger arm 396 includes an aperture 397 in a notched region 395 at a lower end of trigger arm 396 for receiving and engaging a laterally oriented first end part 370 of trigger lever 398.

Trigger lever 398 extends rearwardly from trigger arm 396 in the first wider part 356*a* of slot 356 and also through a second narrower part 356*b* of slot 356 into the space at the junction of grip 54 and upper receiver 352. Trigger lever 398 includes a longitudinally extending end portion 372 adjacent first end part 370 that resides at least partially in slot 356. Trigger lever 398 also includes an offset portion 374 extending laterally (relative to the direction of the trigger pull) and connecting longitudinally extending end portion 372 to an intermediate longitudinally extending portion 376 that is angled upwardly relative to longitudinally extending end portion 372. Trigger lever 398 also includes a U-shaped engagement end 378 extending from and angled downwardly relative to intermediate longitudinally extending portion 376.

Trigger lever 398 extends from trigger arm 396 toward first switch 400, and U-shaped engagement end portion 378 is supported on a flexible actuator 404 of first switch 400 for sliding movement therealong in response to pulling and releasing of trigger 392 to depress a button 406 of first switch 400. Pulling trigger 392 reciprocates trigger arm 396 and trigger lever 398 in slot 356 of trigger guard 354. The U-shaped engagement end portion 378 of trigger lever 398 rides on flexible actuator 404 and pivots flexible actuator 404 to a position 404' as trigger 392 is pulled to position 392', which depresses button 406 to the depressed position 406', as shown in FIG. 21. Pressing button 406 activates the electronic actuator 110 for electronic firing of firearm 350 when the electronic firing mode is selected to activate second switch 130, as discussed above with respect to firearm 50.

Figure 24:
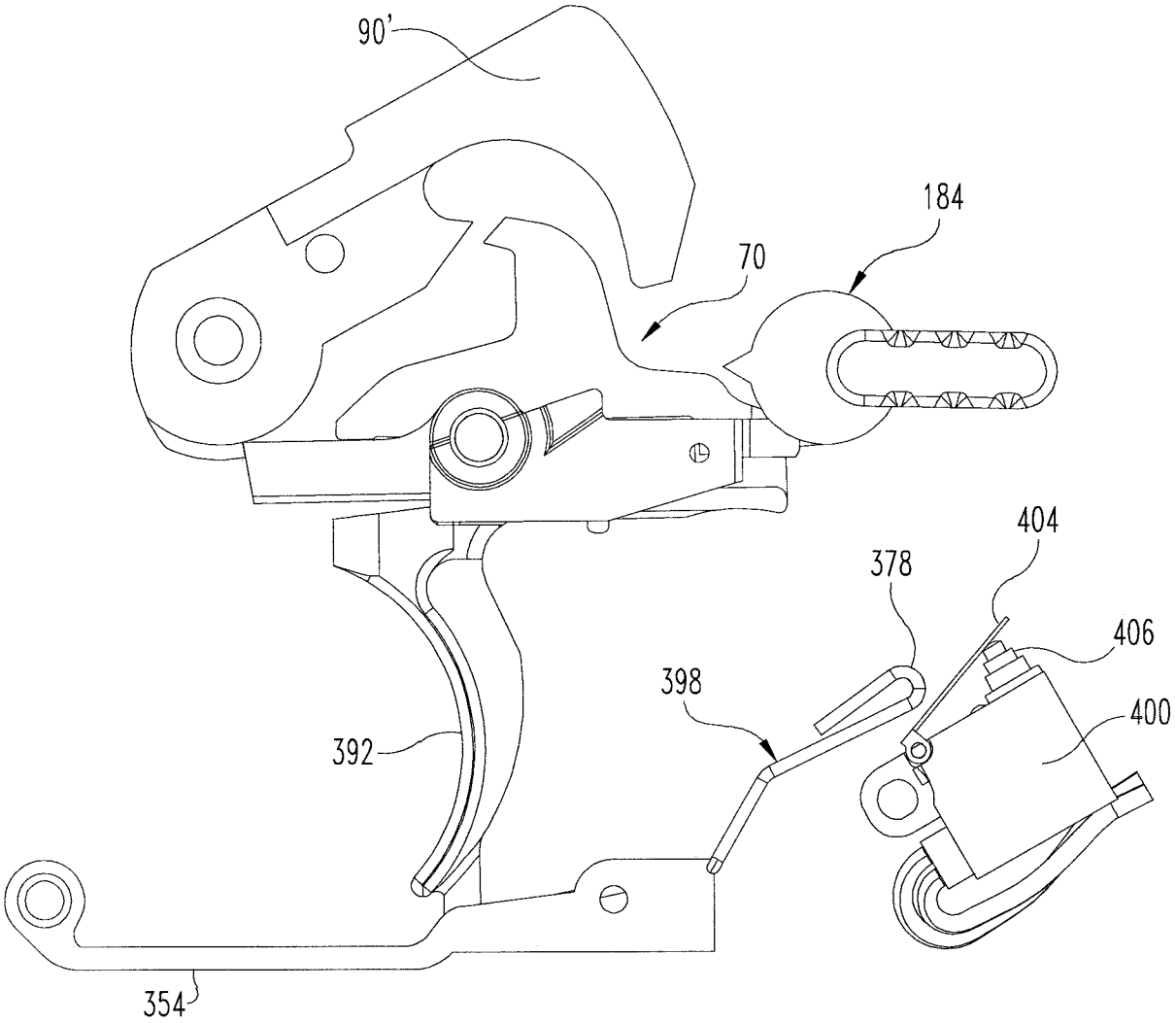
FIG. 24 is a side elevational view showing the trigger group and the first switch of the embodiments of FIGS. 19-21 with the safety selector positioned to place the firearm in an safety mode, and therefore the first switch is disengaged.

Referring to FIG. 24, there is shown a side elevational view of the trigger group including trigger 392, sear assembly 70 and a cocked hammer 90' with the first switch 400 and trigger lever 398 of the embodiments of FIGS. 19-23. The safety selector 184 is positioned to place the firearm in a safety mode of operation as discussed above. Therefore, the second switch 130 is disengaged by selector mechanism 220, disabling the electronic mode of firing even when first button 406 of first switch 400 is pressed. As shown in FIG. 24, trigger 392 is in a neutral or non-pulled position, and U-shaped engagement end portion 378 is spaced from flexible actuator 404. In other embodiments, U-shaped engagement end portion 378 can contact flexible actuator 404 when trigger 392 is in a neutral position.

Figure 25:
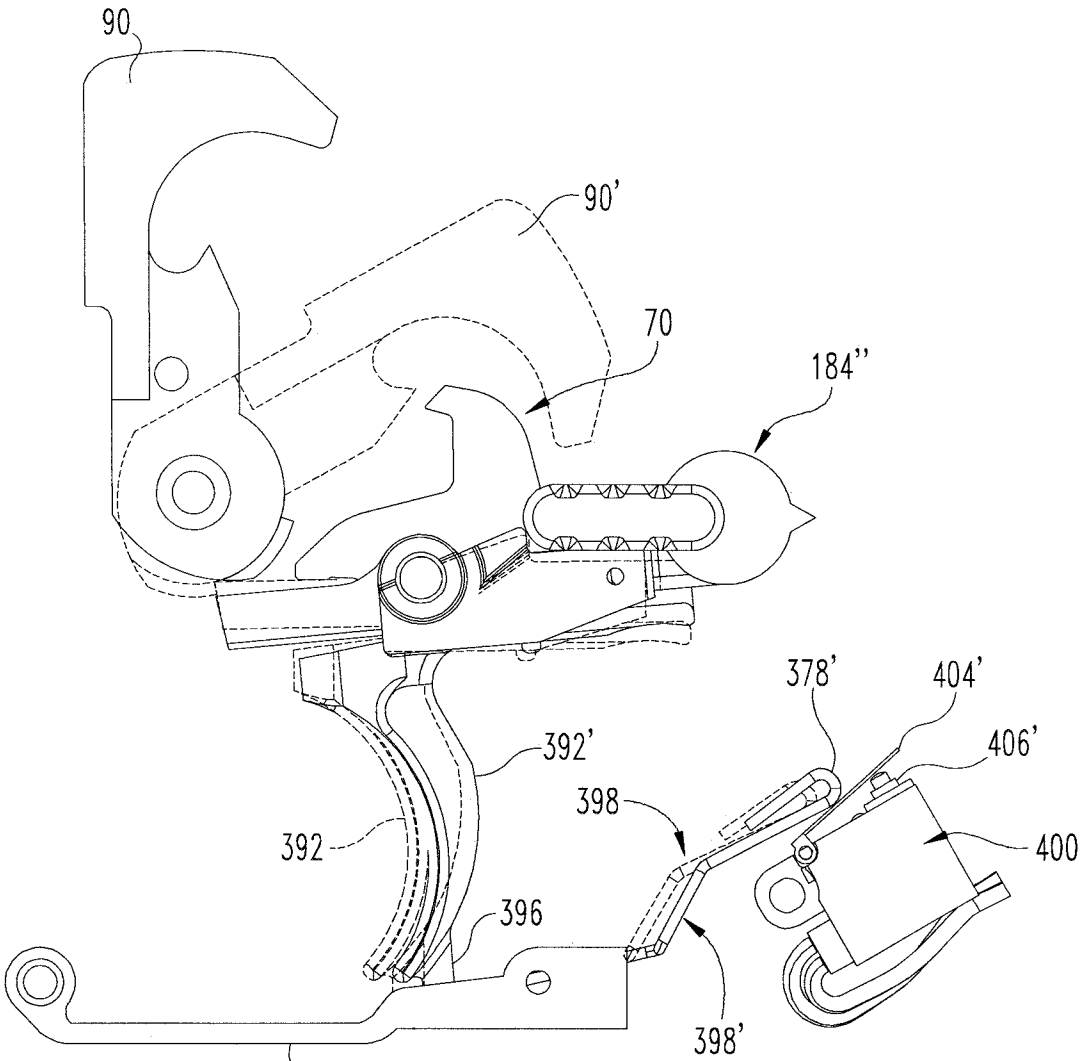
FIG. 25 is a side elevational view showing the trigger group and the first switch of the embodiments of FIGS.

Referring to FIG. 25, there is shown a side elevational view of the trigger group including trigger 392, sear assembly 70 and hammer 90, 90' with the first switch 400 and trigger lever 398 of the embodiments of FIGS. 19-23 with the safety selector 184 positioned in position 184" to place the firearm in an electronic firing mode of operation as discussed above. When trigger 392 is in the neutral position, trigger lever 398 is in the position discussed above with respect to FIG. 24 relative to flexible actuator 404. When trigger 392 is pulled to a first position 392', trigger lever 398 is displaced to a position indicated by trigger lever 398', which in turn contacts U-shaped engagement end portion 378 with flexible actuator 404 to depress button 406, as indicated by the positions of U-shaped engagement end portion 378', flexible actuator 404', and button 406'. Since safety selector 184 is in the electronic firing mode position 184", the second switch 130 is engaged by selector mechanism 220, enabling the electronic mode of firing when first switch 400 is actuated or engaged by pressing button 406.

Referring to FIG. 26, there is shown a side elevational view of the trigger group including trigger 392, sear assembly 70 and hammer 90, 90' with the first switch 400 and trigger lever 398 of the embodiments of FIGS. 19-23 with the safety selector 184 positioned in position 184' to place the firearm in an mechanical firing mode of operation as discussed above. When trigger 392 is in the neutral position, trigger lever 398 is in the position discussed above with respect to FIG. 24 relative to flexible actuator 404. When trigger 392 is pulled to a second position 392" that requires a greater trigger pull distance than first position 392' of FIG. 25, trigger lever 398 is displaced to a position indicated by trigger lever 398". The U-shaped engagement end portion 378 continues to ride along the depressed flexible actuator 404' to the rearward position indicated by the trigger lever 398". Since safety selector 184 is in the mechanical firing mode position 184', the second switch 130 is not engaged by selector mechanism 220, preventing or disabling the electronic mode of firing even when button 406 of first switch 400 is pressed.

Electronic firing assembly 68 can be utilized in conjunction with existing semi-automatic and automatic weaponry designs to improve firearm operations and facilitate selection of the firing mode or safety of the firearm. In addition, the electronically controlled firing mechanism is beneficial in reducing uncertainties associated with trigger pull in mechanical systems, which is commonly known to effect shooting accuracy. Furthermore, the electronic firing assembly 68 includes a means for the shooter to select various manners in which firearm 50 will function when in the electronic firing mode.

Figure 1:
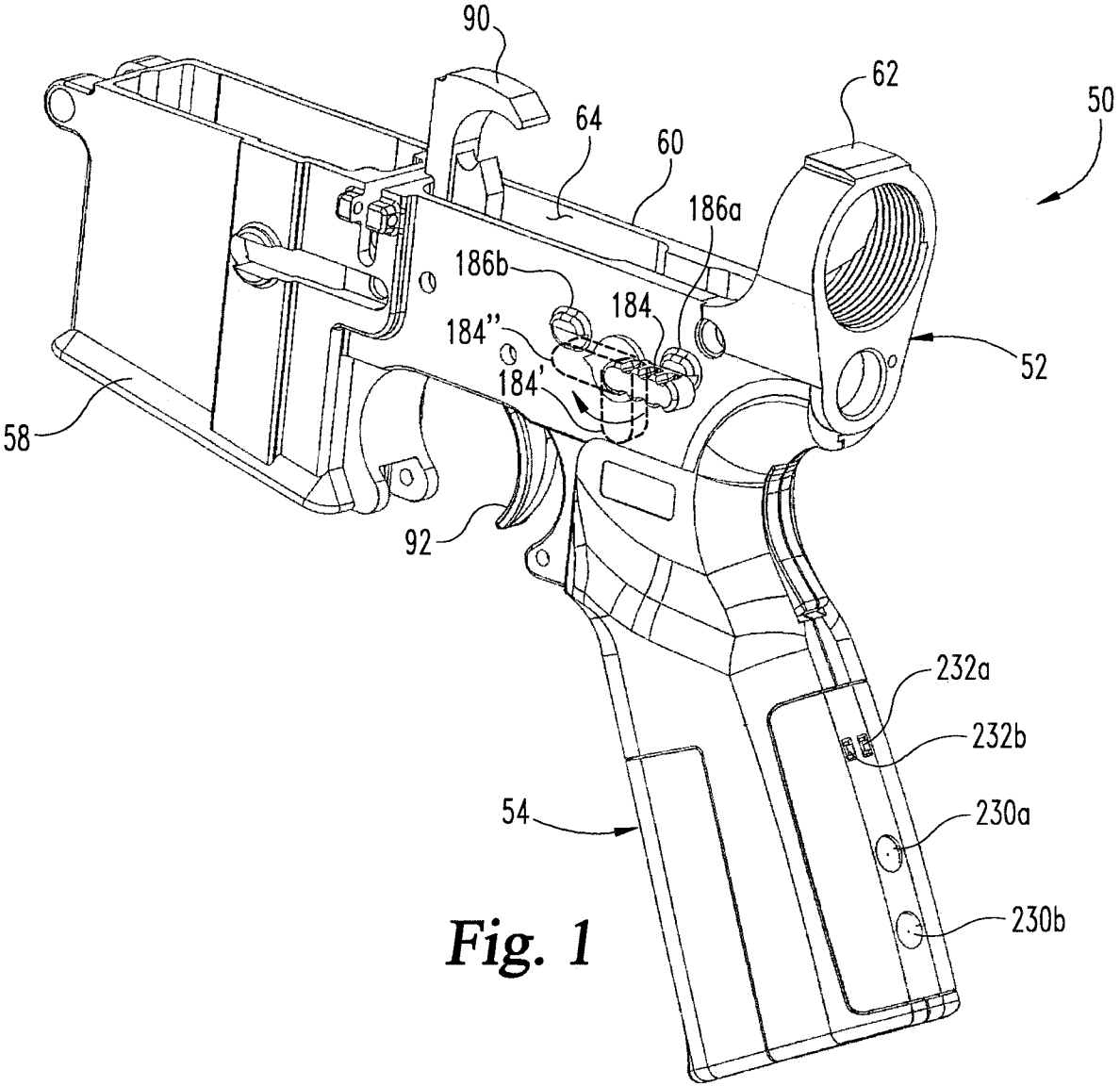
FIG. 1 is a perspective view of a lower receiver/grip assembly of a firearm.
Figure 2:
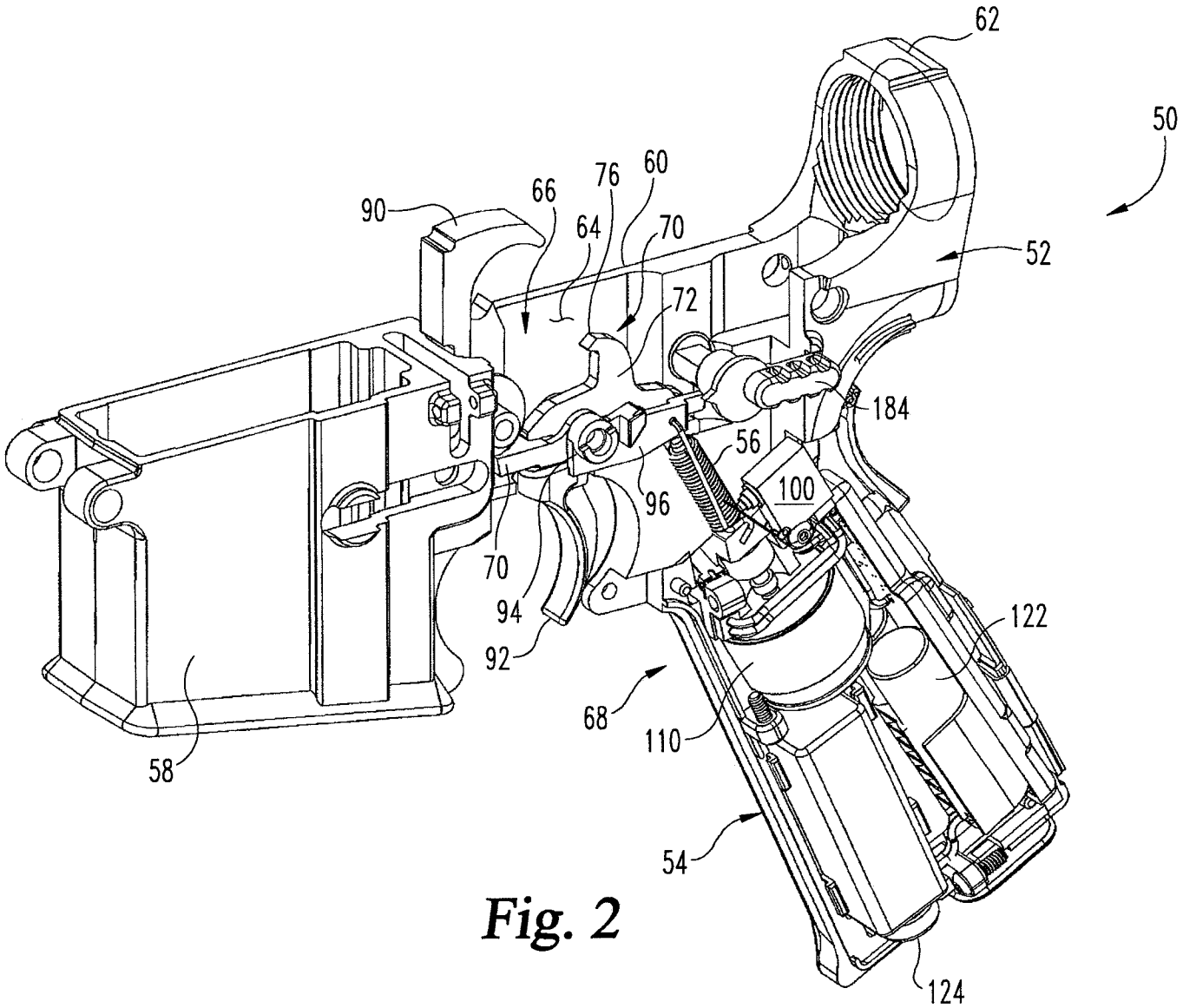
FIG. 2 is a perspective cutaway view of the lower receiver/grip assembly of FIG. 1.
Figure 3:
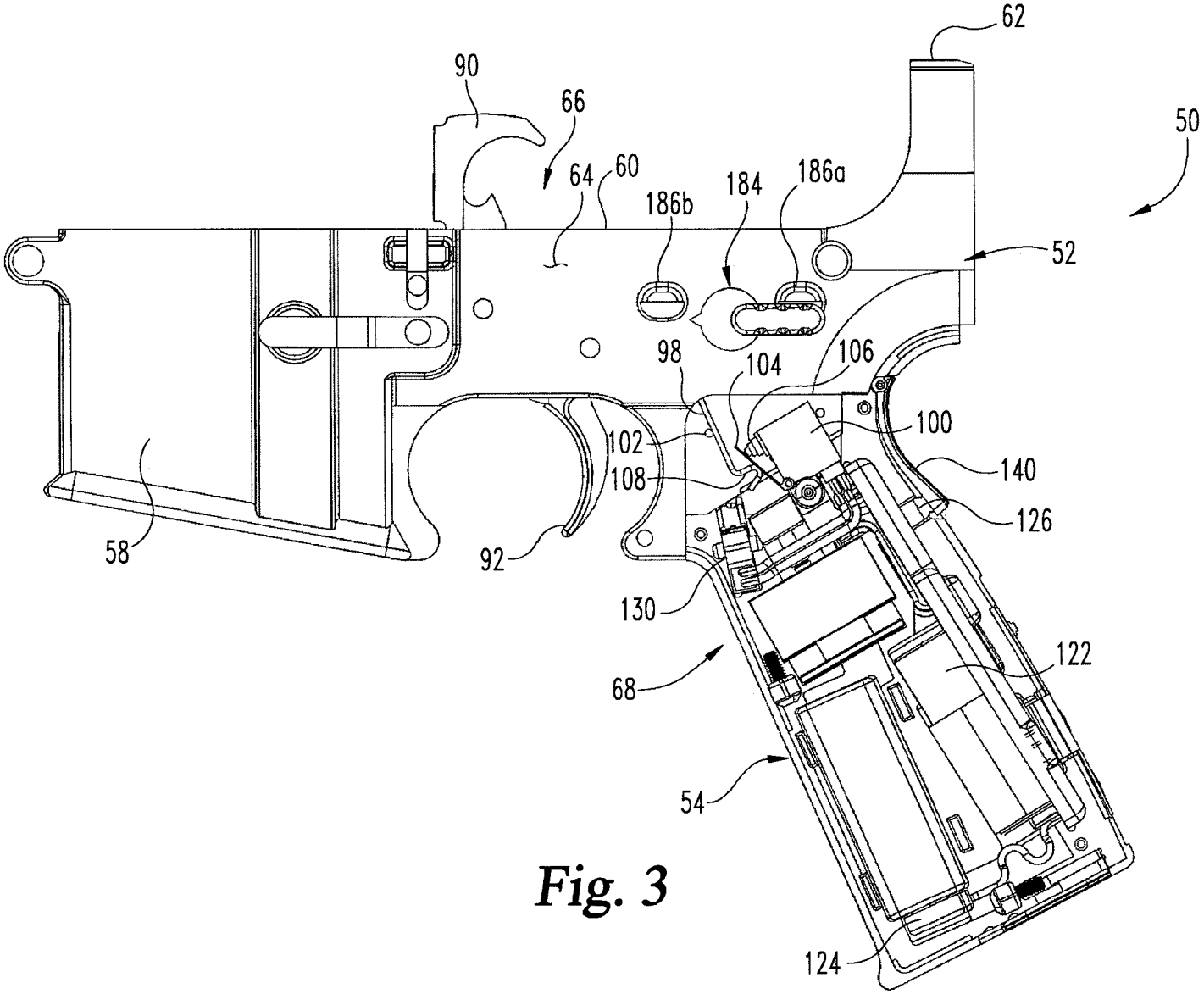
FIG. 3 is a side elevation cutaway view of the lower receiver/grip assembly of FIG. 1.

For example, referring to FIG. 1, grip 54 can include user inputs 230*a*, 230*b* and indicators 232*a*, 232*b* that are connected to printed circuit board 122 with electronic circuit 120. Inputs 230*a*, 230*b* can include, for example, buttons, keypads, voice input devices, or other suitable devices by which the user can input information, and/or to select the behavior or shooting mode for firearm 50 when in the electronic firing mode. Indicators 232*a*, 232*b* can include LED's, lights, audible devices, a display, or other suitable indicator to output various information to the shooter.

Various shooting modes are possible for firearm 50 when in the electronic firing mode. The electronic circuit 120 can include a microprocessor-based control circuit into which the various shooting modes can be programmed. For example, the programmed modes can include a semi-automatic shooting mode in which a single pull of trigger 92 turns on switch 100 to actuate actuator 110 only once. The programmed modes can also include an automatic shooting mode in which a single pull of trigger 92 repeatedly actuates electronic actuator 110 to fire firearm 50 so long as trigger 90 remains pulled to turn on first switch 100. The programmed modes can also include a burst mode in which a single pull of trigger 92 repeatedly actuates electronic actuator 110 to fire a predetermined number of rounds so long as trigger 90 remains pulled to turn on first switch 100. The programmed modes can also include various sub-modes. For example, automatic shooting sub-modes can include firing at a fixed frequency or delay between rounds, at a variable frequency of fire, or at a shooter selected frequency of fire. Burst shooting sub-modes can include allowing a shooter selection of the number of rounds to fire in the burst mode, to select the firing frequency in the burst mode, or to select a variable frequency of fire in the burst mode.

According to one aspect a firearm is provided. The firearm includes a lower receiver and a trigger pivotal relative to the lower receiver. The lower receiver includes a hammer moveable from a cocked position toward an uncocked position to fire the firearm. The lower receiver further includes a sear assembly positionable to secure the hammer in the cocked position and the hammer is releasably engageable to the sear assembly. The firearm includes a grip attached to the lower receiver with a fastening member. The firearm also includes an electronic firing system including an electronic actuator with a sear displacement member that is reciprocally moveable in a bore through the fastening member in response to a pull of the trigger to displace the sear assembly thereby releasing the sear assembly from the hammer when in the cocked position to fire the firearm.

In one embodiment, the trigger is pivotally coupled with the sear assembly. In another embodiment, the fastening member includes a threaded shaft threadingly engaged to the lower receiver and the bore extends through the threaded shaft.

In yet another embodiment, the electronic actuator includes an actuating member that is reciprocally movable to drive the sear displacement member in the bore of the fastening member toward the sear assembly in response to the pull of the trigger. In a refinement of this embodiment, the sear displacement member includes an elongated shaft extending through the fastening member, and the shaft extends between a first end that is adjacent the actuating member and a second end that projects from the fastening member toward the sear assembly. In a further refinement, the fastening member includes a thread shaft and a head at a first end of the threaded shaft and the bore extends through the head. The sear displacement member further includes a spring extending between the fastening member and the flange of the sear displacement member, and the spring biases the sear displacement member toward the actuating member. In a further refinement, the spring contacts a lip in the bore of the fastening member and the lip is between the head and the shaft of the fastening member. In another refinement, the sear displacement member extends through the spring. In another refinement of the embodiment, the electronic actuator includes a solenoid and the actuating member is reciprocally movable through the solenoid.

According to another aspect, a firearm includes a lower receiver, a grip engaged to the lower receiver, and a hammer mounted to the lower receiver. The hammer includes a sear engagement surface. The firearm also includes a sear assembly mounted to the lower receiver. The sear assembly includes a hammer engagement surface that engages the sear engagement surface of the hammer when the hammer is in a cocked position to prevent the hammer from rotating to fire the firearm. The firearm includes a trigger operable to disengage the hammer engagement surface from the sear engagement surface to fire the firearm. The firearm also includes an electronic firing system including an electronic circuit with a power source and an electronic actuator. The electronic firing system further includes a first switch that closes the electronic circuit in response to a pull of the trigger to disengage the hammer engagement surface of the sear assembly from the sear engagement surface of the hammer with the electronic actuator. The electronic firing system also includes a second switch for enabling and disabling the electronic actuator when the second switch is in an on position and an off position, respectively. The firearm also includes a selector mechanism. The selector mechanism also includes a safety selector rotatably mounted to the lower receiver. The safety selector includes a first cam region and a second cam region, and the first cam region is configured to block movement of the sear assembly when the safety selector is in a safety position to prevent disengagement of the hammer engagement surface from the sear engagement surface. The first cam region is further configured to permit movement of the sear assembly when the safety selector is moved from the safety position. The selector mechanism also includes a detent mechanism extending between the second cam region and the second switch. The detent mechanism includes a spring biasing the detent mechanism into engagement with the second cam region. The second cam region is configured so that in the safety position the detent mechanism is disengaged from the second switch to disable the electronic actuator and when the safety selector is moved to an electronic firing mode position the second cam region compresses the spring to engage the detent mechanism with the second switch and place the second switch in the on position to enable the electronic actuator.

In one embodiment, the detent mechanism includes a first rod member extending between a first end engaged to the second cam region and an opposite second. The detent mechanism further includes a second rod member with a first end abuttingly engaged to the second end of the first rod member, and the second rod member extends to a second end adjacent the second switch. In a refinement of this embodiment, the grip includes a support surface and the second rod member includes a flange adjacent the first end of the first rod member. The spring extends from the support surface to the flange to bias the second rod member against the first rod member and the first rod member against the second cam region. In a further refinement, the second switch includes a button that is depressed to enable the electronic actuator and a flexible actuator extending over the button, and the second end of the second rod member contacts the flexible actuator to depress the button.

In another embodiment, the safety selector is movable to a mechanical firing mode position that is between the safety position and the electronic firing mode position. The second cam region is configured so that the detent mechanism is disengaged from the second switch when the safety selector is in the mechanical firing mode position.

In another aspect, a firearm includes a lower receiver and a trigger pivotal relative to the lower receiver about a pin arrangement. The lower receiver includes a hammer moveable from a cocked position toward an uncocked position to fire the firearm, and the lower receiver further includes a sear assembly positionable to secure the hammer in the cocked position. The hammer is releasably engageable to the sear assembly. The firearm includes a grip extending from the lower receiver and an electronic firing system that includes an electronic actuator and a switch that actuates the electronic actuator to disengage the hammer from the sear assembly. The firearm also includes a trigger lever extending toward the first switch, and the trigger lever is displaced by movement of the trigger in response to a pull of the trigger to engage the switch to actuate the electronic actuator.

In one embodiment, the grip is attached to the lower receiver with a fastening member and the electronic actuator includes a sear displacement member that is reciprocally moveable in a bore through the fastening member in response to the pull of the trigger.

In another embodiment, the switch includes a button and a flexible actuator extending along the button, and the trigger lever is movable along the flexible actuator to depress the button in response to the pull of the trigger. In a refinement of this embodiment, the trigger lever extends from a first end attached to the trigger to an opposite end that includes an engagement end portion. The engagement end portion extends along the flexible actuator and, in response to the pull of the trigger, contacts and slides along the flexible actuator to pivot the flexible actuator and depress the button of the switch with the flexible actuator. In a further refinement, the trigger arm includes a notch defining an aperture, and the first end of the trigger lever includes a laterally offset part received in the aperture. In yet a further refinement, the trigger lever includes a longitudinally extending end portion extending in a direction paralleling a direction defined by the pull of the trigger from the laterally offset part. The trigger lever includes an offset portion extending laterally from the longitudinally extending end portion to an intermediate longitudinally extending portion that extends in the direction paralleling the direction defined by the pull of the trigger. The intermediate longitudinally extending portion is angled upwardly relative to the longitudinally extending end portion, and the engagement end portion is U-shaped and angled downwardly relative to the intermediate longitudinally extending portion.

In another embodiment, the trigger includes a trigger arm extending rearwardly from the pin arrangement into the lower receiver, the switch is located in the grip, and the trigger lever extends from the trigger arm to the switch in a direction that is transverse to a direction defined by the pull of the trigger. In yet another embodiment, the lower receiver includes a removable trigger guard defining an elongated slot, the trigger includes a trigger arm extending downwardly from the trigger into the slot in the trigger guard, the switch is located in the grip, and the trigger lever is engaged to and extends from the trigger arm along the slot and into the grip in a direction that parallels a direction defined by the pull of the trigger.

In another embodiment, the firearm includes a selector mechanism including a safety selector, a detent mechanism and a second switch. The safety selector is engaged to the second switch with the detent mechanism, and the selector mechanism is moveable from a first position in which the detent mechanism is located so the second switch is off to disable the electronic actuator to prevent the electronic actuator from being actuated in response to the pull of the trigger to a second position in which the detent mechanism engages the second switch to enable the electronic actuator to be actuated in response to the pull of the trigger.

In yet another aspect, a method for firing a firearm includes: pulling a trigger to actuate an electronic actuator to disengage a sear assembly from a cocked hammer to allow the hammer to rotate to an un-cocked position and fire a first round; re-engaging the hammer with the sear assembly in a cocked position; and after re-engaging the hammer, actuating the electronic actuator in response to releasing the pulled trigger to disengage the sear assembly from hammer in the cocked position to fire a second round.

In one embodiment, the electronic actuator includes a solenoid and a sear displacement member that is reciprocally moveable relative to the solenoid in response to activation of the solenoid. In another embodiment, pulling the trigger engages a switch electronically connected to the electronic actuator. The electronic actuator actuates in response to the switch being engaged by pulling the trigger and the electronic actuator actuates in response to the switch being disengaged when the trigger is released.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method for firing a firearm, comprising:

pulling a trigger to engage a switch that actuates an electronic actuator to disengage a sear assembly from a cocked hammer to allow the hammer to rotate to an un-cocked position and fire a first round;

re-engaging the hammer with the sear assembly in a cocked position; and after re-engaging the hammer, disengaging the switch to by releasing the pulled trigger to actuate the electronic actuator to disengage the sear assembly from the hammer in the cocked position to fire a second round.

2. The method of claim 1, wherein the electronic actuator includes a solenoid and a sear displacement member that is reciprocally moveable relative to the solenoid in response to activation of the solenoid.

3. The method of claim 1, wherein the switch includes a button and a flexible actuator extending along the button, the trigger including a trigger lever being movable along the flexible actuator to depress the button in response to pulling the trigger.

4. The method of claim 3, wherein the trigger lever extends from a first end attached to the trigger to an opposite end that includes an engagement end portion, the engagement end portion extending along the flexible actuator and, in response to pulling the trigger, the engagement end portion contacts and slides along the flexible actuator to pivot the flexible actuator and depress the button of the switch with the flexible actuator.

5. The method of claim 4, wherein the trigger includes a notch defining an aperture, and the first end of the trigger lever includes a laterally offset part received in the aperture.

6. The method of claim 5, wherein the trigger lever includes a longitudinally extending end portion extending in a direction paralleling a direction defined by the pull of the trigger from the laterally offset part, the trigger lever including an offset portion extending laterally from the longitudinally extending end portion to an intermediate longitudinally extending portion that extends in the direction paralleling the direction defined by the pull of the trigger, wherein the intermediate longitudinally extending portion is angled upwardly relative to the longitudinally extending end portion, and further wherein the engagement end portion is fl-shaped and angled downwardly relative to the intermediate longitudinally extending portion.

7. The method of claim 1, further comprising moving a selector mechanism from a first position in which the electronic actuator is disabled to a second position in which the electronic actuator is enabled to actuate in response to both pulling and releasing the trigger.

8. A method, comprising:

moving a selector mechanism from a first position in which an electronic actuator is disabled to a second position in which the electronic actuator is enabled to actuate in response to both a pull of a trigger and a release of the trigger;

pulling the trigger to actuate the electronic actuator to disengage a sear assembly from a cocked hammer to allow the hammer to rotate to an un-cocked position and fire a first round;

re-engaging the hammer with the sear assembly in a cocked position; and after re-engaging the hammer, releasing the trigger to actuate the electronic actuator to disengage the sear assembly from the hammer in the cocked position to fire a second round.

9. The method of claim 8, wherein pulling the trigger engages a switch electronically connected to the electronic actuator, and wherein the electronic actuator actuates in response to the switch being engaged by pulling the trigger and the electronic actuator actuates in response to the switch being disengaged when the trigger is released.

10. The method of claim 9, wherein the selector mechanism includes a safety selector, a detent mechanism and a second switch, wherein the safety selector is engaged to the second switch with the detent mechanism, and in the first position the detent mechanism is located so the second switch is off to disable the electronic actuator to prevent the electronic actuator from being actuated in response to the pull of the trigger and in the second position the detent mechanism engages the second switch to enable the electronic actuator.

11. The method of claim 8, wherein the electronic actuator includes a solenoid and a sear displacement member that is reciprocally moveable relative to the solenoid in response to activation of the solenoid.

* * * * *